US006197154B1

(12) United States Patent
Chen et al.

(10) Patent No.: US 6,197,154 B1
(45) Date of Patent: Mar. 6, 2001

(54) LOW DENSITY RESILIENT WEBS AND METHODS OF MAKING SUCH WEBS

(75) Inventors: Shan Liang Chen, Appleton; Michael Alan Hermans, Neenah; Sheng-Hsin Hu, Appleton; Richard Joseph Kamps, Wrightstown; Jeffrey Dean Lindsay, Appleton, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 08/961,913

(22) Filed: Oct. 31, 1997

(51) Int. Cl.[7] ..... D21F 11/00

(52) U.S. Cl. ..... 162/109; 162/111; 162/113; 162/117

(58) Field of Search ..... 162/109, 111, 162/117, 116, 158, 164.6, 113, 206, 207, 219, 226, 305; 428/211, 153, 152; 34/424, 413, 414

(56) References Cited

U.S. PATENT DOCUMENTS

| | | | |
|---|---|---|---|
| 1,297,192 | 3/1919 | Le Roy et al. . | |
| 1,718,573 | 6/1929 | Millspaugh . | |
| 2,091,805 | 8/1937 | Chuse | 92/38 |
| 2,861,354 | 11/1958 | Hultgreen | 34/68 |
| 2,926,116 | 2/1960 | Keim | 162/164 |
| 3,052,991 | 9/1962 | Goldner | 34/89 |

(List continued on next page.)

FOREIGN PATENT DOCUMENTS

| | | | |
|---|---|---|---|
| 677083 | 12/1963 | (CA) . | |
| 0 033 559 A2 | 8/1981 | (EP) | D21F/11/00 |
| 0 328 227 A2 | 8/1989 | (EP) | F26B/13/20 |
| 0 502 602 A1 | 9/1992 | (EP) | F26B/13/10 |
| 0 574 366 A1 | 12/1993 | (EP) | D21F/11/14 |
| 0 616 074 A1 | 9/1994 | (EP) | D21F/11/00 |
| 679469 | 4/1930 | (FR) . | |

(List continued on next page.)

OTHER PUBLICATIONS

Bieman, Leonard H., Kevin G. Harding, and Albert Boehnlein, "Absolute Measurement Using Field Shifted Moiré," *Optics, Illumination, and Image Sensing for Machine Vision VI*, SPIE Proceedings Series, Nov. 14–15, 1991, vol. 1614, pp. 259–264.

Bowden, Edward V., "Non–Contact Drying and Turning—the 'On Machine' Technology of the Nineties,"*Appita*, vol. 44, No. 1, Jan. 1991, pp. 41–46.

Haberl, Andrew et al., "First Linerboard Application Of The Gas Heated Paper Dryer," *45th Appita Annual General Conference Proceedings*, vol. 1, 1991, pp. 47–50.

Kufferath, W. et al., "Die Sonic–Roll," *Das Papier*, 42(10A): V140, 1988.

Lindsay, Jeffrey D. and Leonard H. Bieman, "Exploring Tactile Properties of Tissue With Moire Interferometry," *Non–Contact, Three–Dimensional Gaging Methods and Technologies Workshop*, Dearborn, Michigan, Mar. 1997.

(List continued on next page.)

*Primary Examiner*—Stanley S. Silverman
*Assistant Examiner*—Jose A. Fortuna
(74) *Attorney, Agent, or Firm*—Thomas M. Gage; Patricia A. Charlier

(57) ABSTRACT

A method for making a textured tissue sheet on a conventional tissue making machine using a conventional cylindrical drum dryer creates a product that is remarkably bulky, soft, and wet resilient. A combination of rush transfer and sheet molding with three-dimensional fabrics is combined with the step of web inversion to ensure that the surface of the web which was molded onto a first textured transfer fabric is the surface which is placed against the surface of the cylinder dryer. Web inversion improves machine productivity and enhances physical properties of the web.

36 Claims, 6 Drawing Sheets

U.S. PATENT DOCUMENTS

| | | | | |
|---|---|---|---|---|
| 3,058,873 | | 10/1962 | Keim et al. | 162/164 |
| 3,084,448 | | 4/1963 | Dungler | 34/155 |
| 3,176,412 | | 4/1965 | Gardner | 34/122 |
| 3,208,158 | | 9/1965 | Smith, Jr. | 34/122 |
| 3,220,914 | | 11/1965 | Boadway et al. | 161/128 |
| 3,224,926 | | 12/1965 | Bernardin | 162/146 |
| 3,224,928 | | 12/1965 | Lee et al. . | |
| 3,284,285 | | 11/1966 | Holden | 162/297 |
| 3,303,576 | | 2/1967 | Sisson | 34/115 |
| 3,319,354 | | 5/1967 | Hering, Jr. et al. | 34/155 |
| 3,340,617 | | 9/1967 | Carroll, Jr. | 34/18 |
| 3,371,427 | | 3/1968 | Thygeson, Sr. | 34/155 |
| 3,434,922 | | 3/1969 | Ely . | |
| 3,447,247 | | 6/1969 | Daane | 34/122 |
| 3,455,778 | | 7/1969 | Bernardin | 162/113 |
| 3,537,954 | | 11/1970 | Justus | 162/305 |
| 3,541,697 | | 11/1970 | Villalobos . | |
| 3,574,261 | | 4/1971 | Bailey | 34/23 |
| 3,577,651 | | 5/1971 | Nichols | 34/155 |
| 3,587,177 | | 6/1971 | Overly et al. | 34/156 |
| 3,599,341 | | 8/1971 | Darcy et al. | 34/23 |
| 3,607,624 | | 9/1971 | Moody et al. | 162/272 |
| 3,617,442 | | 11/1971 | Hurschman | 162/212 |
| 3,629,056 | | 12/1971 | Forrest | 162/305 |
| 3,729,376 | | 4/1973 | Stevens | 162/306 |
| 3,771,236 | | 11/1973 | Candor et al. | 34/16 |
| 3,771,239 | | 11/1973 | Minoda et al. | 34/156 |
| 3,810,818 | | 5/1974 | Arledter | 162/301 |
| 3,812,598 | | 5/1974 | Lefebvre et al. | 34/155 |
| 3,822,182 | | 7/1974 | Heyse et al. | 162/207 |
| 3,844,881 | | 10/1974 | Moody | 162/297 |
| 3,849,904 | | 11/1974 | Villalobos | 34/155 |
| 3,895,449 | | 7/1975 | Chance et al. | 34/155 |
| 3,913,241 | | 10/1975 | Chaikin et al. | 34/122 |
| 3,923,593 | | 12/1975 | Verseput | 162/301 |
| 3,930,319 | | 1/1976 | Coleman | 34/122 |
| 4,072,557 | | 2/1978 | Schiel | 162/111 |
| 4,074,441 | | 2/1978 | Helversen et al. | 34/122 |
| 4,102,737 | | 7/1978 | Morton . | |
| 4,120,747 | | 10/1978 | Sarge, III et al. | 162/117 |
| 4,121,968 | | 10/1978 | Wells | 162/290 |
| 4,125,430 | | 11/1978 | Grossman | 162/207 |
| 4,157,938 | | 6/1979 | Clemens et al. | 162/207 |
| 4,163,688 | | 8/1979 | Kankaanpaa | 162/359 |
| 4,183,147 | | 1/1980 | Kawaguchi | 34/16 |
| 4,197,973 | | 4/1980 | Daane | 226/97 |
| 4,201,323 | | 5/1980 | Stibbe et al. | 226/97 |
| 4,309,246 | | 1/1982 | Hulit et al. | 162/113 |
| 4,345,385 | | 8/1982 | Sando et al. | 34/23 |
| 4,356,059 | * | 10/1982 | Hostetler | 162/111 |
| 4,361,466 | | 11/1982 | Wong et al. | 162/207 |
| 4,364,185 | | 12/1982 | Dussourd et al. | 34/122 |
| 4,421,600 | | 12/1983 | Hostetler | 162/111 |
| 4,440,597 | | 4/1984 | Wells et al. | 162/111 |
| 4,462,868 | | 7/1984 | Oubridge et al. | 162/280 |
| 4,528,316 | | 7/1985 | Soerens | 524/503 |
| 4,529,480 | | 7/1985 | Trokhan | 162/109 |
| 4,541,895 | | 9/1985 | Albert | 162/348 |
| 4,551,199 | | 11/1985 | Weldon | 162/109 |
| 4,556,450 | | 12/1985 | Chuang et al. | 162/204 |
| 4,559,105 | | 12/1985 | Sennett et al. . | |
| 4,571,359 | | 2/1986 | Dutt | 428/240 |
| 4,637,859 | | 1/1987 | Trokhan | 162/109 |
| 4,787,641 | | 11/1988 | Rautakorpi et al. | 277/135 |
| 4,835,880 | | 6/1989 | Vecchia | 34/115 |
| 4,849,054 | | 7/1989 | Klowak | 162/109 |
| 4,871,425 | | 10/1989 | Gunderson | 162/290 |
| 4,888,096 | | 12/1989 | Cowan et al. | 162/358 |
| 4,892,622 | | 1/1990 | Malkki et al. | 162/208 |
| 4,915,788 | | 4/1990 | Winheim | 162/207 |
| 4,953,297 | | 9/1990 | Eskelinen et al. | 34/23 |
| 4,976,821 | | 12/1990 | Laapotti | 162/360.1 |
| 4,986,009 | | 1/1991 | Haessner et al. | 34/23 |
| 5,043,046 | | 8/1991 | Laapotti | 162/358 |
| 5,048,589 | | 9/1991 | Cook et al. | 162/109 |
| 5,070,627 | | 12/1991 | Zagar | 34/156 |
| 5,070,628 | | 12/1991 | Zagar | 34/156 |
| 5,078,835 | | 1/1992 | Schiel et al. . | |
| 5,085,737 | | 2/1992 | Brogyanyi et al. | 162/359 |
| 5,105,562 | | 4/1992 | Hella et al. | 34/156 |
| 5,129,988 | | 7/1992 | Farrington, Jr. | 162/123 |
| 5,137,600 | | 8/1992 | Barnes et al. | 162/115 |
| 5,149,401 | | 9/1992 | Langevin et al. | 162/207 |
| 5,187,219 | | 2/1993 | Furman, Jr. | 524/377 |
| 5,225,042 | | 7/1993 | Eaton et al. | 162/203 |
| 5,230,776 | | 7/1993 | Andersson et al. | 162/290 |
| 5,262,010 | | 11/1993 | Bubik et al. . | |
| 5,274,930 | | 1/1994 | Ensign et al. | 34/23 |
| 5,336,373 | | 8/1994 | Scattolino et al. | 162/116 |
| 5,348,620 | | 9/1994 | Hermans et al. | 162/9 |
| 5,381,580 | | 1/1995 | Kotitschke et al. | 15/302 |
| 5,411,636 | | 5/1995 | Hermans et al. | 162/109 |
| 5,429,686 | | 7/1995 | Chiu et al. | 139/383 A |
| 5,471,765 | | 12/1995 | Rautakorpi et al. | 34/242 |
| 5,490,903 | | 2/1996 | Chen et al. | 162/111 |
| 5,501,768 | | 3/1996 | Hermans et al. | 162/9 |
| 5,508,095 | | 4/1996 | Allum et al. | 428/242 |
| 5,556,053 | | 9/1996 | Henseler | 242/541.6 |
| 5,598,643 | | 2/1997 | Chuang et al. | 34/406 |
| 5,601,871 | | 2/1997 | Krzysik et al. | 427/288 |
| 5,607,551 | | 3/1997 | Farrington, Jr. et al. | 162/109 |
| 5,611,893 | | 3/1997 | Pajula et al. | 162/360.2 |
| 5,614,293 | * | 3/1997 | Krzysik et al. | 428/211 |
| 5,620,566 | | 4/1997 | Holopainen | 162/205 |
| 5,625,961 | | 5/1997 | Ensign et al. | 34/117 |
| 5,656,132 | | 8/1997 | Farrington, Jr. et al. | 162/117 |
| 5,667,636 | | 9/1997 | Engel et al. | 162/117 |
| 5,746,887 | * | 5/1998 | Wendt et al. | 162/109 |
| 5,772,845 | * | 6/1998 | Farrington, Jr. et al. | 162/109 |

FOREIGN PATENT DOCUMENTS

| | | | |
|---|---|---|---|
| 1235868 | 5/1960 | (FR) . | |
| 2 303 116 | 10/1976 | (FR) | D21H/5/12 |
| 1057373 | 2/1967 | (GB) . | |
| 2 152 961 | 8/1985 | (GB) | B31F/1/12 |
| 2 179 949 | 3/1987 | (GB) | C08L/31/04 |
| 2 179 953 | 3/1987 | (GB) | C09J/3/00 |
| 2 235 754 | 3/1991 | (GB) | F26B/13/12 |
| 2 254 288 | 10/1992 | (GB) | B32B/3/24 |
| WO 90/04676 A1 | 5/1990 | (WO) | D21F/9/00 |
| WO 91/16493 A1 | 10/1991 | (WO) | D21F/9/00 |
| WO 93/23616 A1 | 11/1993 | (WO) | D21F/11/14 |
| WO 95/00706 A1 | 1/1995 | (WO) | D21H/27/30 |
| WO 97/43483 A1 | 11/1997 | (WO) | D21F/11/00 |
| WO 97/43484 A1 | 11/1997 | (WO) | D21F/11/00 |
| 99/23303 * | 5/1999 | (WO) . | |

OTHER PUBLICATIONS

Lindsay, Jeffrey D., "Displacement Dewatering To Maintain Bulk," *Paperi Ja Puu–Paper And Timber*, vol. 74, No. 3, 1992, pp. 232–242.

Mummery, Leigh, *Surface Texture Analysis: The Handbook*, published by Hommelwerke GmbH, Muhlhausen, Germany, 1990, pp. 37–45.

Page, R.H. and J. Seyed–Yagoobi, "A New Concept For Air Or Vapor Impingement Drying," *Tappi Journal*, 73(9), Sep. 1990, pp. 229–234.

TAPPI Official Test Method T 494 om–88, "Tensile Breaking Properties Of Paper And Paperboard (Using Constant Rate Of Elongation Apparatus)," published by the TAPPI Press, Atlanta, Georgia, revised 1988, pp. 1–5.

TAPPI Useful Method UM 256, "Water Retention Value (WRV)," published by the TAPPI Press, Atlanta, Georgia, pp. 54–56.

Thiele, P.E. and R.H. Page, "Enhancement Of Drying Rate, Moisture Profiling And Sheet Stability On An Existing Paper Machine With RJR Blow Boxes," *1995 Papermakers Conference*, Tappi Press, Atlanta, Georgia, 1995, pp. 223–228.

* cited by examiner

LOW DENSITY RESILIENT WEBS AND METHODS OF MAKING SUCH WEBS

BACKGROUND OF THE INVENTION

The present invention relates generally to methods for making tissue products. More particularly, the invention concerns methods for making tissue having high bulk and absorbency on a modified conventional wet-pressing machine.

In the art of tissue making, large steam-filled cylinders known as Yankee dryers are commonly used to dry a tissue web that is pressed onto the dryer cylinder surface while the tissue web is still wet. In conventional tissue making, the wet paper web is firmly pressed against the surface of the Yankee dryer. The compression of the wet web against the dryer surface provides intimate contact for rapid heat transfer into the web. As the web dries, adhesive bonds form between the surface of the Yankee dryer and the tissue web, often promoted by sprayed-on adhesive applied before the point of contact between the wet web and the dryer surface. The adhesive bonds are broken when the flat, dry web is scraped off the dryer surface by a creping blade, which imparts a fine, soft texture to the web, increases bulk, and breaks many fiber bonds for improved softness and reduced stiffness.

Traditional creping suffers from several drawbacks. Because the sheet is pressed flat against the Yankee, the hydrogen bonds that develop as the web dries are formed between the fibers in a flat, dense state. Although creping imparts many kinks and deformations in the fibers and adds bulk, when the creped sheet is wetted, the kinks and deformations relax as the fibers swell. As a result, the web tends to return to the flat state set when the hydrogen bonds were formed. Thus, a creped sheet tends to collapse in thickness and expand laterally in the machine direction upon wetting, often becoming wrinkled in the process if some parts of the laterally expanding web are restrained, still dry, or held against another surface by surface tension forces.

Further, creping limits the texture and bulk that can be imparted to the web. Relatively little can be done with the conventional operation of Yankees to produce a highly textured web such as the throughdried webs that are produced on textured throughdrying fabrics. The flat, dense structure of the web upon the Yankee sharply limits what can be achieved in terms of the subsequent structure of the product coming off the Yankee.

The foregoing and other drawbacks of traditional creping may be avoided by producing an uncreped throughdried tissue web. Such webs may be produced with a bulky three-dimensional structure rather than being flat and dense, thereby providing good wet resiliency. It is known, however, that uncreped tissue often tends to be stiff and lacks the softness of creped products. Additionally, throughdried webs sometimes suffer from pinholes in the web due to the flow of air through the web to achieve full dryness. Moreover, most of the world's paper machines use conventional Yankee dryers and tissue manufacturers are reluctant to accept the high cost of adding throughdrying technology or the higher operating costs associated with throughdrying.

Prior attempts to make an uncreped sheet on a drum dryer or Yankee have included wrapping the sheet around the dryer. For example, cylinder dryers have long been used for heavier grades of paper. In conventional cylinder drying, the paper web is carried by dryer fabrics which wrap the cylinder dryer to provide good contact and prevent sheet flutter. Unfortunately, such wrapping configurations are not practical for converting a modern creped tissue machine into an uncreped tissue machine. Moreover, without creping, the web may be stiff and have low internal bulk (low pore space between fibers). Further, high speed operation may not be possible due to impaired heat transfer. When a web is not heavily pressed into a flat state against the Yankee or drum dryer surface, conductive heat transfer is reduced and the drying rate is cut substantially. Another problem encountered at high speed is the difficulty of removing a web from a fabric to place it on the Yankee, especially if the fabric is highly textured or three-dimensional. The web often becomes firmly attached to the fabric, and the process of transferring the web from the fabric to the Yankee may cause picking of the web or other signs of undesirable sheet disruption or failure. Additionally, at commercial speeds, the problem of attaching and removing an uncreped, textured sheet from a Yankee surface is exceedingly difficult, as described hereinafter.

Prior tissue manufacturing methods have also employed rush transfer or negative draw of a wet sheet to improve the flexibility and softness of an uncreped, noncompressively dried sheet. The combination of rush transfer, web molding into a three-dimensional fabric, and drum drying, however, especially when operated without creping at industrially useful speeds, leads to several problems in practice which have not previously been recognized or solved. In particular, Applicants have discovered that the most highly stressed portions of the rush transferred sheet, when pressed onto the Yankee surface for drying, may fail or remain adhered to the Yankee when the sheet is removed with or without creping. The problem can be most harmful in uncreped operation because portions of the sheet may stick to the Yankee without a crepe blade to effect good removal, but degradation of sheet quality will also occur with creped operation. The result may be a high number of sheet breaks or an acceptable product having low strength, nonuniform properties, and sheet defects.

Thus, there is a need for a tissue making operation that overcomes the above-referenced problems of sheet molding, drying, attachment, and release on a Yankee dryer. In particular, there is a need for a process which allows uncreped or lightly creped production of textured tissue on a drum dryer at industrially useful speeds with minimal sheet failures. Desirably, the tissue sheet resulting from such operation has a three-dimensional topography for high apparent bulk, a noncompressively dried structure for high inherent bulk (defined hereinafter) and softness, and low damage during attachment and release for high strength of the soft, absorbent sheet.

SUMMARY OF THE INVENTION

It has been discovered that a soft, high bulk, textured, wet resilient tissue web can be produced using a conventional Yankee dryer or drum dryers in place of through-air drying in the production of wet-laid tissue. Accomplishing this objective has required combining several operations in a particular manner designed to provide the desired properties and to prevent a critical problem that affects prior techniques for making textured, high-bulk tissue with Yankee drying. That critical problem centers around the interaction of rush transfer, three-dimensional fabrics, and sheet attachment to the Yankee. In particular, it has been discovered that, under certain operating conditions, a web that has been rush transferred onto a highly three-dimensional first transfer fabric has a tendency, if transferred directly onto a Yankee dryer, to fail or pick during removal from the dryer at high speed if the sheet is dried to industrially valuable dryness levels. This serious impediment to production can be largely overcome, however, if the rush-transferred sheet on the three-dimensional fabric is subsequently transferred to a second transfer fabric or felt before being placed on the Yankee or drum dryer surface. The orientation of the sheet is thereby reversed relative to the surface of the dryer. The second transfer fabric or felt desirably has lower fabric coarseness than the first transfer fabric, but desirably has some degree of three-dimensionality in its surface structure to preserve or enhance the texture of the web.

While rush transfer of a web from a first carrier fabric onto a three-dimensional first transfer fabric is desirable for creating bulk, stretch, and texture, Applicants have nevertheless found that this process leads to serious runnability problems when followed by Yankee drying, especially in uncreped mode. It is hypothesized that the process of rush transfer creates stress and microcompactions in the wet web where fibers have been rearranged by friction and shear between the two fabrics traveling at different velocities. In particular, after rush transfer onto a three-dimensional first transfer fabric, it appears that the most elevated portions of the web with respect to the underlying three-dimensional fabric have been particularly stressed or strained, with thin, weak regions adjacent the most elevated portions. If the web on the three-dimensional fabric is then pressed onto a Yankee, it is the highly strained, most elevated regions of the web which will be pressed most firmly onto the Yankee. Those firmly pressed regions will experience the highest stress during removal of the sheet from the Yankee, and are likely to stick, break, or fail during removal. In particular, the thinned regions near the most elevated portions of the web on the three-dimensional rush transfer fabric are regions of likely failure when the sheet is detached from the Yankee or drum dryer. Capillary forces and other chemical forces create attachment between the dryer surface and the regions of the moist web that are pressed against the Yankee, and in subsequently overcoming those adhesive forces, the web may fail or suffer degradation in quality when it is then removed from the dryer. If the web is removed from the dryer surface without creping, failure or web picking is likely, and sheet problems may still occur in creped operation.

For good runnability and web strength, the molded web should experience at least one additional transfer to a second transfer fabric to ensure that the most elevated portions of the web with respect to the first transfer fabric are not the regions most strongly attached to the drum dryer surface. In one particular embodiment, the elevated bumps of the web after the first rush transfer operation are placed into depressed pockets of a second transfer fabric, and the second transfer fabric is used to place the web against a drum dryer. Consequently, the web is reversed so that the uppermost surface relative to the first transfer fabric becomes the lowermost surface on the second transfer fabric. The transferred sheet can then be placed on a dryer drum and removed with or without creping with less likelihood of picking or failing. Even without registering the bumps of the web into the pockets of a second transfer fabric, simply inverting the web in any way onto the second transfer fabric is expected to have beneficial results for subsequent drum drying.

It is hypothesized that reversing the sheet in this manner will ensure that the weakest regions of the web, regions which have been stressed or scraped by the relative motion of the faster-moving carrier fabric during rush transfer, are not those that most firmly adhere to the Yankee. As a result, the regions undergoing the greatest stress upon removal of the sheet from the dryer surface are less likely to fail. The methods disclosed herein permit a web to be rush transferred, molded on a three-dimensional fabric and dried on a Yankee dryer at industrially useful speeds. Web inversion can be achieved with a second transfer step followed by deposition of the web onto the dryer surface. Actually, any odd number of additional transfer steps to additional fabric loops could be used, after the first transfer stage, to ensure that web inversion has occurred.

Hence in one respect, the invention resides in a method for producing a tissue web comprising the steps of: a) depositing an aqueous suspension of papermaking fibers onto a forming fabric to form a wet web; b) dewatering the wet web to a consistency suitable for a rush transfer operation; c) rush transferring the dewatered web to a first transfer fabric having a three-dimensional topography; d) transferring the web to a second transfer fabric; e) transferring the web to the surface of a drum dryer; and f) removing the web from the surface of the drum dryer.

In another respect, the invention resides in a method for producing a tissue web comprising the steps of: a) depositing an aqueous suspension of papermaking fibers onto a forming fabric to form a wet web; b) dewatering the wet web to a consistency of about 20 percent or greater; c) rush transferring the dewatered web to a first transfer fabric having a three-dimensional topography with a greater Fabric Coarseness than the forming fabric; d) transferring the web to a second transfer fabric having a lower Fabric Coarseness than the first transfer fabric; e) transferring the web from the second transfer fabric to the surface of a drum dryer with a pressure adapted to maintain a substantially three-dimensional topography in the web; f) drying the web; and g) removing the web from the surface of the drum dryer.

In one particular embodiment, the web is transferred briefly from the first transfer fabric to a second transfer fabric and then returned to the first transfer fabric with new registration relative to the first transfer fabric. As a result, the previously mentioned weakened, most elevated portions of the web after rush transfer desirably become re-registered or shifted to more depressed portions of the fabric so that the previously elevated, stressed regions do not become the primary attachment points to the drum dryer. Even without precisely re-registering the web on the first transfer fabric, transferring the web away from the first transfer fabric and returning it to the first transfer fabric desirably rearranges the fibers on the web to improve subsequent drum drying and reduce the likelihood of failure upon detachment. Further, the first detachment of the web from the first transfer fabric will decrease the degree of fiber-fabric entanglement and reduce picking problems when the web is removed from the first transfer fabric again as it is placed on the drum dryer, thus decreasing the likelihood of problems at the dryer.

A "drum dryer," as used herein, is a heated cylindrical dryer with a substantially impermeable outer surface adapted for providing thermal energy to a paper web by thermal conduction from the outer surface of the dryer. Examples of drum dryers include, but are not limited to, the conventional steam-filled Yankee dryer or improvements thereof; other conventional steam-filled cylindrical dryers commonly used in the art of papermaking; internally heated gas-fired cylindrical dryers such as those produced by Flakt-Ross of Montreal, Canada and described by A. Haberl et al., "The First Linerboard Application of the Gas Heated Paper Dryer," Proceedings of the CPPA 77$^{th}$ Annual Technical Session, Vol. B., Montreal, Canada, January 1991; electrically heated cylinders that are heated by induction or electrical resistance elements in the shell; cylinders heated by internal flows of hot oil or thermofluids in association with a heat exchanger; radiatively heated cylinders heated by infrared-red radiation from gas burners or electrical elements; cylinders heated by external contact with flame or heated gas, and the like.

In other embodiments, the second transfer fabric is desirably less coarse or textured than the first transfer fabric to improve the contact of the web to the dryer surface and thus improve heat transfer, without eliminating the texturizing effect of the first transfer fabric. The second transfer fabric and optionally the forming fabric may of course also impart texture to the web.

Further, Applicants have observed that, even without Yankee drying, a moist web which is rush transferred onto a coarse first transfer fabric and then transferred without substantial rush (i.e., without significant differential velocity) onto a less coarse second transfer fabric will have higher strength at a given degree of MD stretch (or higher stretch at a given strength) compared to a similar web that is first transferred without rush onto a less coarse fabric and then transferred with rush onto a coarse second transfer fabric. It is believed that having a second transfer to a less coarse fabric after a first rush transfer operation onto a coarse fabric helps to relax some of the strained areas of the web before drying is complete, thus reducing the opportunities for failure or crack propagation in the dried web. Therefore, it is believed that a rush transfer operation onto a coarse fabric, followed by a second transfer stage onto a second transfer fabric, puts the web into an excellent condition for subsequent drying on a Yankee cylinder if the sheet is to have good strength and good stretch.

It is also believed that using a second transfer fabric to attach the web to the Yankee improves the web attachment. In particular, the method of attaching a web to the Yankee directly from a first transfer fabric often becomes problematic at high speed because the web does not release well from the three-dimensional or highly textured first transfer fabric. This occurs because the web tends to become embedded in the fabric after rush transfer or after dewatering with differential pressure. When the web is pressed onto the Yankee by the first transfer fabric, the web may remain adhered to the first transfer fabric and cause picking or web failure. By transferring the web from the first transfer fabric onto a second transfer fabric, however, the web can be nondestructively dislodged from the first transfer fabric. The web will generally not become as well attached to the second transfer fabric, which desirably is less textured (e.g., has a smaller peak to valley height defined by the solid elements on the surface) than the first transfer fabric, thus allowing the second transfer fabric to press the web against the cylinder dryer surface and to release the web without picking or causing other incipient forms of sheet failure.

Attaching the wet web to the Yankee or other heated dryer surface is desirably done with relatively little compression of the web in order to preserve a substantial part of the texture imparted by the previous fabrics. The conventional manner used to produce creped paper is inadequate for this purpose, for in that method, a pressure roll is used to compact the web into a dense, flat state on the Yankee for maximum heat transfer by conduction. Lower pressing pressures should be used for the present invention. Specifically, the pressing pressure applied to the web should be less than about 400 psi, particularly less than about 150 psi, more particularly less that about 60 psi, such as between about 2 and about 50 psi, and more particularly less than about 30 psi. The pressing pressure applied to the web is the average pressure measured in psi (pounds per square inch) across one-inch square regions encompassing the zone of maximum pressure. The pressing pressures measured in pounds per lineal inch (pli) at the point of maximum pressure are desirably about 100 pli (pounds per linear inch) or less, preferably about 50 pli or less, and more preferably from about 2 to about 30 pli.

The pressure roll may alternatively be disengaged from the cylinder dryer and contact between the web and the dryer surface promoted instead by fabric tension in a fabric wrap section. Whether the pressure roll is engaged or not, the second transfer fabric may wrap the cylinder dryer for a machine direction length of at least about 2 feet, particularly at least about 4 feet, more particularly still at least about 7 feet, and more particularly still at least about 10 feet. For embodiments involving significant fabric wrap, the degree of fabric wrap should be no more than 60 percent of the machine direction perimeter (circumference) of the cylindrical dryer, and particularly should be about 40 percent or less, more particularly about 30 percent or less, and most particularly between about 5 and about 20 percent of the circumference of the cylindrical dryer. The fabric desirably wraps the dryer for less than the full distance that the web is in contact with the dryer, and in particular the fabric separates from the web prior to the web entering the dryer hood. The length of fabric wrap may depend on the coarseness of the fabric.

Presuming that compressive dewatering has been avoided prior to web application on the cylinder dryer surface, low-pressure application helps to maintain substantially uniform density in the dried web. Substantially uniform density is also promoted by effectively dewatering the web with noncompressive means to relatively high dryness levels prior to Yankee attachment. More specifically, the web is desirably noncompressively dewatered to a consistency as it is put on the cylinder dryer of greater than about 25 percent, particularly greater than about 30 percent, such as between about 32 and about 45 percent, more particularly greater than about 35 percent, such as between about 35 and about 50 percent, and still more particularly greater than about 40 percent. Also, the fabric selected to contact the web against the dryer is desirably relatively free of high, inflexible protrusions that could apply high local pressure to the web. Useful techniques for supplemental dewatering, beyond what is normally possible with conventional foils and vacuum boxes, include an air press in which high pressure air passes through the moist web to drive out liquid water, capillary dewatering, steam treatment, and the like.

In particular embodiments, the web may be removed from the Yankee or other heated dryer surface without creping. An interfacial control mixture comprising adhesive compounds and release agents suitable for removing the web without creping is disclosed in U.S. patent application Ser. No. unknown filed on the same day as the present application by F. G. Druecke et al. titled "Method Of Producing Low Density Resilient Webs," which is incorporated herein by reference. Alternatively, the web may be creped and in particular lightly creped from the cylinder drying surface. Light creping leaves the surface topography relatively undisturbed and is associated with low cohesive forces on the cylinder dryer. Creping adhesives and/or chemical release agents may be applied to a surface of the web or to the cylinder dryer surface to promote attachment and/or effective removal of the web from the dryer surface.

The step of partially dewatering the embryonic web prior to the rush transfer step can be achieved in any of the methods known in the art. Dewatering at fiber consistencies less than about 30 percent is desirably substantially nonthermal. Nonthermal dewatering means include drainage through the forming fabric induced by gravity, hydrodynamic forces, centrifugal force, vacuum or applied gas pressure, or the like. Partial dewatering by nonthermal means may include those achieved through the use of foils and vacuum boxes on a Fourdrinier or in a twin-wire type former or top-wire modified Fourdrinier, vibrating rolls or "shaker" rolls, including the "sonic roll" described by W. Kufferath et al. in *Das Papier*, 42(10A): V140 (1988), couch rolls, suction rolls, or other devices known in the art. Differential gas pressure or applied capillary pressure across the web may also be used to drive liquid water from the web, as provided by the air presses disclosed in U.S. patent application Ser. No. 08/647,508 filed May 14, 1996, by M. A. Hermans et al. titled "Method and Apparatus for Making Soft Tissue" and U.S. patent application Ser. No. unknown filed on the same day as the present application by F. Hada et al. titled "Air Press For Dewatering A Wet Web"; the paper machine disclosed in U.S. Pat. No. 5,230,776 issued Jul. 27, 1993 to I. A. Andersson et al.; the capillary dewatering techniques disclosed in U.S. Pat. No. 5,598,643 issued Feb. 4, 1997 and U.S. Pat. No. 4,556,450 issued Dec. 3, 1985, both to S. C. Chuang et al.; and the dewatering concepts disclosed by J. D. Lindsay in "Displacement Dewatering to Maintain Bulk," *Paperi ja Puu*, 74(3): 232–242 (1992); which are all incorporated herein by reference. The air press is especially preferred because it can be added economically as a relatively simple machine rebuild and offers high efficiency and good dewatering.

The step of rush transfer can be performed with many of the methods known in the art, particularly for example as disclosed in U.S. patent application Ser. No. 08/790,980 filed Jan. 29, 1997 by Lindsay et al. and titled "Method For Improved Rush Transfer To Produce High Bulk Without Macrofolds"; U.S. patent application Ser. No. 08/709,427 filed Sep. 6, 1996 by Lindsay et al. and titled "Process For Producing High-Bulk Tissue Webs Using Nonwoven Substrates"; U.S. Pat. No. 5,667,636 issued Sep. 16, 1997 to S. A. Engel et al.; and U.S. Pat. No. 5,607,551 issued Mar. 4, 1997 to T. E. Farrington, Jr. et al.; which are incorporated herein by reference. For good sheet properties, the first transfer fabric may have a fabric coarseness (hereinafter defined) of about 30 percent or greater, particularly from about 30 to about 300 percent, more particularly from about 70 to about 110 percent, of the strand diameter of the highest warp or chute of the fabric, or, in the case of nonwoven fabrics, of the characteristic width of the highest elongated structure on the surface of fabric. Typically, strand diameters can range from about 0.005 to about 0.05 inch, particularly from about 0.005 to about 0.035 inch, and more specifically from about 0.010 to about 0.020 inch.

For acceptable heat transfer on the dryer surface, the second transfer fabric desirably has a lower coarseness that the first transfer fabric. The ratio of the second transfer fabric coarseness to the first transfer fabric coarseness is desirably about 0.9 or less, particularly about 0.8 or less, more particularly between about 0.3 and about 0.7, and still more particularly between about 0.2 and about 0.6. Likewise, the surface depth of the second transfer fabric should desirably be less than the surface depth of the first transfer fabric, such that the ratio of surface depth in the second transfer fabric to surface depth of the second transfer fabric is about 0.95 or less, more particularly about 0.85 or less, more particularly between about 0.3 and about 0.75, and still more particularly between about 0.15 and about 0.65.

While woven fabrics are most popular for their low cost and runnability, nonwoven materials are available and under development as replacements for conventional forming fabrics and press felts, and may be used in the present invention. Examples include U.S. patent application Ser. No. 08/709,427 filed Sep. 6, 1996, by J. Lindsay et al. titled "Process for Producing High-bulk Tissue Webs Using Nonwoven Substrates."

In another respect, the invention resides in a tissue web produced according to the above-referenced methods. In particular embodiments, the tissue web has: a Surface Depth (defined hereinafter) of at least 0.1 mm, particularly at least about 0.2 mm, and more at least about 0.3 mm; an ABL value (defined hereinafter) of at least 0.2 km; a machine direction stretch of at least 6 percent; and/or a cross-machine direction stretch of at least 6 percent.

Without the limitations imposed by creping, the chemistry of the uncreped sheet can be varied to achieve novel effects. With creping, for example, high levels of debonders or sheet softeners may interfere with adhesion on the Yankee, but in the uncreped mode, much higher add on levels can be achieved. Emollients, lotions, moisturizers, skin wellness agents, silicone compounds such as polysiloxanes, and the like can now be added at desirably high levels without regard to crepe performance. In practice, however, care must be applied to achieve proper release from the second transfer fabric and to maintain some minimum level of adhesion on the dryer surface for effective drying and control of flutter. Principles for obtaining these objectives are disclosed in U.S. patent application Ser. No. unknown filed on the same day as the present application by F. G. Druecke et al. titled "Method Of Producing Low Density Resilient Webs." Nevertheless, without relying on creping, there will be much greater freedom in the use of new wet end chemistries and other chemical treatments under the present invention compared to creping methods.

With respect to the above embodiments, many fiber types may be used including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulosic fibers, cellulose derivatives, and chemically stiffened or crosslinked fibers) or synthetic fibers (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulping processes), thermomechanically pulped, chemithermomechanically pulped, and the like. Mixtures of any subset of the above mentioned or related fiber classes may be used.

In one embodiment the fibrous slurry contains high yield fibers in a proportion of about 10 percent or greater, particularly about 20 percent or greater, and more particularly about 50 percent or greater, and still more particularly over 70 percent. Webs made with high yield fibers tend to have high degrees of wet resiliency. Wet resiliency is also promoted when effective amounts of wet strength agents are added to the slurry or to the web to give a wet:dry tensile ratio of about 10 percent or greater, particularly about 20 percent or greater, more particularly about 30 percent or greater and still more particularly about 40 percent or greater. Chemically stiffened or cross-linked fibers may also be used in a concentration of about 10 percent or greater and particularly about 25 percent or greater for improved wet resiliency in some embodiments. For cost effectiveness and other reasons, some embodiments of the present invention may include webs comprising about 10 percent or greater recycled fibers, particularly about 20 percent or greater recycled fibers, and more particularly still about 30 percent or greater recycled fibers, and even essentially 100 percent recycled fibers.

Fibers useful for the present invention can be prepared in a multiplicity of ways known to be advantageous in the art. Useful methods of preparing fibers include dispersion to impart curl and improved drying properties, such as disclosed in U.S. Pat. No. 5,348,620 issued Sep. 20, 1994 and U.S. Pat. No. 5,501,768 issued Mar. 26, 1996, both to M. A. Hermans et al., which are incorporated herein by reference. Various combinations of fiber types, fiber treatment methods, and web forming methods such as rush transfer may be employed to make webs according to the present invention.

Chemical additives may also be used and may be added to the original fibers, to the fibrous slurry or added on the web during or after production. Such additives include opacifiers, pigments, wet strength agents, dry strength agents, softeners, emollients, viricides, bactericides, buffers, waxes, fluoropolymers, odor control materials, zeolites, dyes, fluorescent dyes or whiteners, perfumes, debonders, vegetable and mineral oils, humectants, sizing agents, superabsorbents, surfactants, moisturizers, UV blockers, antibiotic agents, lotions, fungicides, preservatives, aloe-vera extract, vitamin E, or the like. The application of chemical additives need not be uniform, but may vary in location and from side to side in the tissue. Hydrophobic material may be deposited on a portion of the surface of the web to enhance properties of the web.

A single headbox or a plurality of headboxes may be used. The headbox or headboxes may be stratified to permit production of a multilayered structure from a single headbox jet in the formation of a web. Preferably, the web is formed on an endless loop of foraminous forming fabric which permits drainage of the liquid and partial dewatering of the web. Multiple embryonic webs from multiple headboxes may be couched or mechanically or chemically joined in the moist state to create a single web having multiple layers.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DEFINITION OF TERMS AND PROCEDURES

Figure 1:
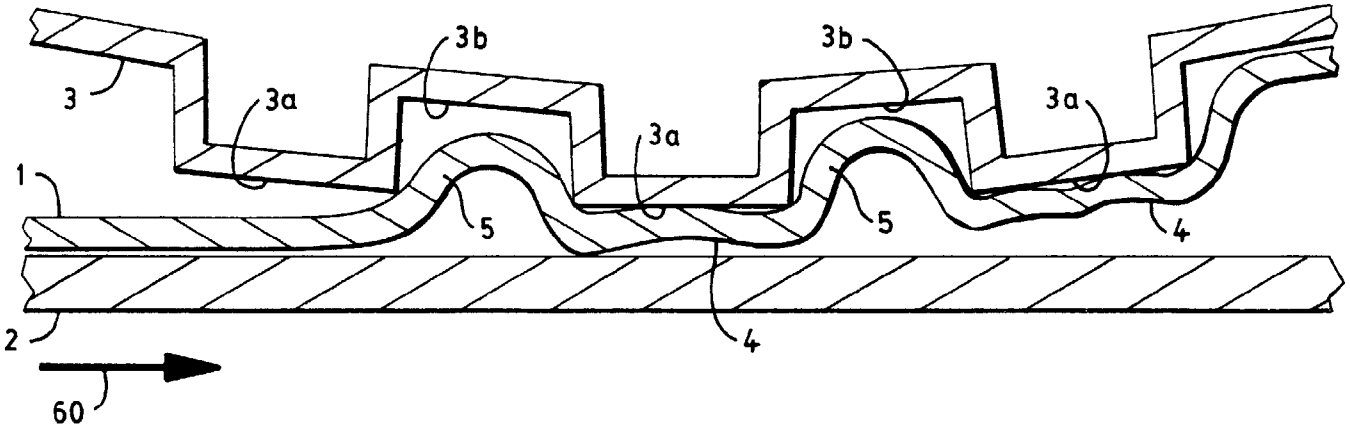
FIG. 1 representatively shows a cross section view of a rush transfer nip where a web is transferred from a carrier fabric to a textured transfer fabric.

As used herein, "thickness" of a web, unless otherwise specified, refers to thickness measured with a 3-inch diameter platen-based thickness gauge at a load of 0.05 psi.

As used herein, "MD tensile strength" of a tissue sample is the conventional measure, known to those skilled in the art, of load per unit width at the point of failure when a tissue web is stressed in the machine direction. Likewise, "CD tensile strength" is the analogous measure taken in the cross-machine direction. MD and CD tensile strength are measured using an Instron tensile tester using a 3-inch jaw width, a jaw span of 4 inches, and a crosshead speed of 10 inches per minute. Prior to testing the sample is maintained under TAPPI conditions (73° F., 50% relative humidity) for 4 hours before testing. Tensile strength is reported in units of grams per inch (at the failure point, the Instron reading in grams is divided by 3 since the test width is 3 inches).

"MD stretch" and "CD stretch" refer to the percent elongation of the sample during tensile testing prior to failure. Tissue produced according to the present invention can have a MD stretch about 3 percent or greater, such as from about 4 to about 24 percent, about 5 percent or greater, about 8 percent or greater, about 10 percent or greater and more particularly about 12 percent or greater. The CD stretch of the webs of the present invention is imparted primarily by the molding of a wet web onto a highly contoured fabric. The CD stretch can be about 4 percent or greater, about 6 percent or greater, about 8 percent or greater, about 9 percent or greater, about 11 percent or greater, or from about 6 to about 15 percent.

As used herein, the "ABL" factor (Adjusted Breaking Length) of a web is MD tensile strength divided by basis weight, expressed in units of kilometers. For example, a web with an MD tensile strength of 300 g/in and a basis weight of 30 gsm (grams per square meter) has an ABL factor of (300 g/in)/(30 g/meter squared)*(39.7 in/m)*(1 km/1000 m)=0.4 km.

As used herein, the "wet:dry ratio" is the ratio of the geometric mean wet tensile strength divided by the geometric mean dry tensile strength. Geometric mean tensile strength (GMT) is the square root of the product of the machine direction tensile strength and the cross-machine direction tensile strength of the web. Unless otherwise indicated, the term "tensile strength" means "geometric mean tensile strength." The webs of this invention can have a wet:dry ratio of about 0.1 or greater, more specifically about 0.15 or greater, more specifically about 0.2 or greater, still more specifically about 0.3 or greater, and still more specifically about 0.4 or greater, and still more specifically from about 0.2 to about 0.6.

As used herein, "high-speed operation" or "industrially useful speed" for a tissue machine refers to a machine speed at least as great as any one of the following values or ranges, in feet per minute: 1,000; 1,500; 2,000; 2,500; 3,000; 3,500; 4,000; 4,500; 5,000, 5,500; 6,000; 6,500; 7,000; 8,000; 9,000; 10,000, and a range having an upper and a lower limit of any of the above listed values.

As used herein, "industrially valuable dryness levels" can be about 60 percent or greater, about 70 percent or greater, about 80 percent or greater, about 90 percent or greater, between about 60 and about 95 percent, or between about 75 and about 95 percent. For the present invention, the web should be dried on the cylinder dryer to industrially valuable dryness levels.

As used herein, "Surface Depth" refers to the characteristic peak-to-valley height difference of a textured three-dimensional surface. It can refer to the characteristic depth or height of a molded tissue structure. An especially suitable method for measurement of Surface Depth is moiré interferometry, which permits accurate measurement without deformation of the surface. For reference to the materials of the present invention, surface topography should be measured using a computer-controlled white-light field-shifted moiré interferometer with about a 38 mm field of view. The principles of a useful implementation of such a system are described in Bieman et al., "Absolute Measurement Using Field-Shifted Moiré," SPIE Optical Conference Proceedings, Vol. 1614, pp. 259–264, 1991. A suitable commercial instrument for moiré interferometry is the CADEYES® interferometer produced by Medar, Inc. (Farmington Hills, Mich.), constructed for a 38-mm field-of-view (a field of view within the range of 37 to 39.5 mm is adequate). The CADEYES® system uses white light which is projected through a grid to project fine black lines onto the sample surface. The surface is viewed through a similar grid, creating moiré fringes that are viewed by a CCD camera. Suitable lenses and a stepper motor adjust the optical configuration for field shifting (a technique described below). A video processor sends captured fringe images to a PC computer for processing, allowing details of surface height to be back-calculated from the fringe patterns viewed by the video camera. Principles of using the CADEYES system for analysis of characteristic tissue peak-to-valley height are given by J. D. Lindsay and L. Bieman, "Exploring Tactile Properties of Tissue with Moiré Interferometry," *Proceedings of the Non-contact, Three-dimensional Gaging Methods and Technologies Workshop*, Society of Manufacturing Engineers, Dearborn, Mich., Mar. 4–5, 1997.

The height map of the CADEYES topographical data can then be used by those skilled in the art to identify characteristic unit cell structures (in the case of structures created by fabric patterns; these are typically parallelograms arranged like tiles to cover a larger two-dimensional area) and to measure the typical peak to valley depth of such structures or other arbitrary surfaces. A simple method of doing this is to extract two-dimensional height profiles from lines drawn on the topographical height map which pass through the highest and lowest areas of the unit cells or through a sufficient number of representative portions of a periodic surface. These height profiles can then be analyzed for the peak to valley distance, if the profiles are taken from a sheet or portion of the sheet that was lying relatively flat when measured. To eliminate the effect of occasional optical noise and possible outliers, the highest 10 percent and the lowest 10 percent of the profile should be excluded, and the height range of the remaining points is taken as the surface depth. Technically, the procedure requires calculating the variable which we term "P10," defined as the height difference between the 10% and 90% material lines, with the concept of material lines being well known in the art, as explained by L. Mummery, in *Surface Texture Analysis*: The Handbook, Hommelwerke GmbH, Mühlhausen, Germany, 1990. In this approach, the surface is viewed as a transition from air to material. For a given profile, taken from a flat-lying sheet, the greatest height at which the surface begins—the height of the highest peak—is the elevation of the "0% reference line" or the "0% material line," meaning that 0 percent of the length of the horizontal line at that height is occupied by material. Along the horizontal line passing through the lowest point of the profile, 100 percent of the line is occupied by material, making that line the "100% material line." In between the 0% and 100% material lines (between the maximum and minimum points of the profile), the fraction of horizontal line length occupied by material will increase monotonically as the line elevation is decreased. The material ratio curve gives the relationship between material fraction along a horizontal line passing through the profile and the height of the line. The material ratio curve is also the cumulative height distribution of a profile. (A more accurate term might be "material fraction curve.")

Once the material ratio curve is established, one can use it to define a characteristic peak height of the profile. The P10 "typical peak-to-valley height" parameter is defined as the difference between the heights of the 10% material line and the 90% material line. This parameter is relatively robust in that outliers or unusual excursions from the typical profile structure have little influence on the P10 height. The units of P10 are mm. The Surface Depth of a material is reported as the P10 surface depth value for profile lines encompassing the height extremes of the typical unit cell of that surface. "Fine surface depth" is the P10 value for a profile taken along a plateau region of the surface which is relatively uniform in height relative to profiles encompassing a maxima and minima of the unit cells. Measurements are reported for the most textured side of the materials of the present invention if two-sidedness is present.

Surface Depth is intended to examine the topography produced in the basesheet, especially those features created in the sheet prior to and during drying processes, but is intended to exclude "artificially" created large-scale topography from dry converting operations such as embossing, perforating, pleating, etc. Therefore, the profiles examined should be taken from unembossed regions if the sheet has been embossed, or should be measured on an unembossed sheet. Surface Depth measurements should exclude large-scale structures such as pleats or folds which do not reflect the three-dimensional nature of the original basesheet itself. It is recognized that sheet topography may be reduced by calendering and other operations which affect the entire basesheet. Surface Depth measurement can be appropriately performed on a calendered sheet.

As used herein, "lateral length scale" refers to a characteristic dimension of a textured three-dimensional web having a texture comprising a repeating unit cell. The minimum width of a convex polygon circumscribing the unit cell is taken as the lateral length scale. For example, in a tissue throughdried on a fabric having repeating rectangular depressions spaced about 1 mm apart in the cross direction and about 2 mm apart in the machine direction, the lateral length scale would be about 1 mm. The textured fabrics (transfer fabrics and felts) described in this invention can have periodic structures displaying a lateral length scale of at least any of the following values: about 0.5 mm, about 1 mm, about 2 mm, about 3 mm, about 5 mm, and about 7 mm.

As used herein, "MD unit cell length" refers to the machine-direction extent (span) of a characteristic unit cell in a fabric or tissue sheet characterized by having a repeating structure. The textured fabrics (transfer fabrics and felts) described in this invention can have periodic structures displaying a lateral length scale of at least any of the following values: about 1 mm, about 2 mm, about 5 mm, about 6 mm, and about 9 mm.

As used herein, "fabric coarseness" refers to the characteristic maximum vertical distance spanned by the upper surfaces of a textured fabric which can come into contact with a paper web deposited thereon.

In one embodiment of the present invention, one or both of the transfer fabrics are made according to the teachings of U.S. Pat. No. 5,429,686 issued Jul. 4, 1995 to K. F. Chiu et al., which is incorporated herein by reference. The three-dimensional fabric disclosed therein has a load-bearing layer adjacent the machine-face of the fabric, and has a three-dimensional sculpture layer on the pulp face of the fabric. The junction between the load-bearing layer and the sculpture layer is called the "sublevel plane". The sublevel plane is defined by the tops of the lowest CD knuckles in the load-bearing layer. The sculpture on the pulp face of the fabric is effective to produce a reverse image impression on the pulp web carried by the fabric.

The highest points of the sculpture layer define a top plane. The top portion of the sculpture layer is formed by segments of "impression" warps formed into MD impression knuckles whose tops define the top plane of the sculpture layer. The rest of the sculpture layer is above the sublevel plane. The tops of the highest CD knuckles define an intermediate plane which may coincide with the sublevel plane, but more often it is slightly above the sublevel plane. The intermediate plane must be below the top plane by a finite distance which is called "the plane difference." The "plane difference" of the fabrics disclosed by Chiu et al. or of similar fabrics can be taken as the "fabric coarseness." For other fabrics, the fabric coarseness can generally be taken as the difference in vertical height between the most elevated portion of the fabric and the lowest surface of the fabric likely to contact a paper web.

A specific measure related to fabric coarseness is the "Putty Coarseness Factor," wherein the vertical height range of a putty impression of the fabric is measured. Dow Corning® Dilatant Compound 3179, which has been sold commercially under the trademark SILLY PUTTY, is brought to a temperature of 73° F. and molded into a flat, uniform disk 2.5 inches in diameter and ¼ inch in thickness. The disk is placed on one end of a brass cylinder with a mass of 2046 grams and measuring 2.5 inches in diameter and 3 inches tall. The fabric to be measured is placed on a clean, solid surface, and the cylinder with the putty on one end is inverted and placed gently on the fabric. The weight of the cylinder presses the putty against the fabric. The weight remains on the putty disk for a period of 20 seconds, at which time the cylinder is lifted gently and smoothly, typically bringing the putty with it. The textured putty surface that was in contact with the fabric can now be measured by optical means to obtain estimates of the characteristic maximum peak to valley height difference measured as the P10 parameter previously described herein. The measurement to be reported is the highest of two mean P10 values, one for the machine direction and one for the cross-direction. The mean for either direction is the average P10 value of at least 10 profile sections parallel to the direction of interest, each profile section being approximately 15-mm long or longer and spaced apart on the surface to obtain a reasonable representation of the height differences on the surface. For example, putty impressions of several Lindsay Wire TAD fabrics with elongated machine direction structures gave the highest mean P10 value when averages were taken for the cross direction. One fabric, for example, had a mean P10 value of 0.68 mm in the cross machine direction (CD) and 0.47 mm in the machine direction (MD), for which the Putty Coarseness Factor would be reported as 0.68 mm. Another fabric had a CD mean P10 value of 1.16 mm based on 15 profile lines of 20 mm length, compared to 0.64 mm in the machine direction, for which the Putty Coarseness Factor would be reported as 1.16 mm. A useful means for such measurement is the CADEYES moiré interferometer, described above, with a 38-mm field of view. The measurement should be made within 2 minutes of removing the brass cylinder.

The porosity of the fabric determines its ability to pass air or moisture or water through the fabric to achieve the desired moisture content in the web carried by the fabric. The porosity is determined by the warp density (percent warp coverage) and the orientation and spacing of the warps and shutes in the fabric.

As used herein, the term "textured" or "three-dimensional" as applied to the surface of a fabric, felt, or uncalendered paper web, indicates that the surface is not substantially smooth and coplanar. In particular, it denotes that the surface has a Surface Depth, fabric coarseness, or Putty Coarseness value of at least 0.1 mm, such as between about 0.2 and about 0.8 mm, particularly at least 0.3 mm, such as between about 0.3 and 1.5 mm, more particularly at least 0.5 mm, and still more particularly at least 0.7 mm. In particular embodiments of the present invention, the first transfer fabric has a Putty Coarseness Factor of 0.2 mm to 2.0 mm, and more particularly the first transfer fabric has a Putty Coarseness of at least 0.5 mm and the second transfer fabric has a Putty Coarseness at least about 20 percent less than the Putty Coarseness of the first transfer fabric.

The "warp density" is defined as the total number of warps per inch of fabric width, times the diameter of the warp strands in inches, times 100.

We use the terms "warp" and "shute" to refer to the yarns of the fabric as woven on a loom where the warp extends in the direction of travel of the fabric through the paper making apparatus (the machine direction) and the shutes extend across the width of the machine (the cross-machine direction). Those skilled in the art will recognize that it is possible to fabricate the fabric so that the warp strands extend in the cross-machine direction and the weft strands extend in the machine direction. Such fabrics may be used in accordance with the present invention by considering the weft strands as MD warps and the warp strands as CD shutes. The warp end shute yarns may be round, flat, or ribbon-like, or a combination of these shapes.

As used herein, "high yield pulp fibers" are those papermaking fibers produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. Such pulping processes include bleached chemithermomechanical pulp (BCTMP), chemithermomechanical pulp (CTMP) pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness (in both dry and wet states) relative to typical chemically pulped fibers. The cell wall of kraft and other non-high yield fibers tends to be more flexible because lignin, the "mortar" or "glue" on and in part of the cell wall, has been largely removed. Lignin is also nonswelling in water and hydrophobic, and resists the softening effect of water on the fiber, maintaining the stiffness of the cell wall in wetted high yield fibers relative to kraft fibers. The preferred high yield pulp fibers can also be characterized by being comprised of comparatively whole, relatively undamaged fibers, high freeness (250 Canadian Standard Freeness (CSF) or greater, more specifically 350 CSF or greater, and still more specifically 400 CSF or greater), and low fines content (less than 25 percent, more specifically less than 20 percent, still more specifically less that 15 percent, and still more specifically less than 10 percent by the Britt jar test). Webs made with recycled fibers are less likely to achieve the wet resiliency properties of the present invention because of damage to the fibers during mechanical processing. In addition to common papermaking fibers listed above, high yield pulp fibers also include other natural fibers such as milkweed seed floss fibers, abaca, hemp, kenaf, bagasse, cotton and the like.

As used herein, "wet resilient pulp fibers" are papermaking fibers selected from the group comprising high-yield pulp fibers, chemically stiffened fibers and cross-linked fibers. Examples of chemically stiffened fibers or cross-linked fibers include mercerized fibers, HBA fibers produced by Weyerhaeuser Corp., and those such as described in U.S. Pat. No. 3,224,926, "Method of Forming Cross-linked Cellulosic Fibers and Product Thereof," issued in 1965 to L. J. Bernardin, and U.S. Pat. No. 3,455,778, "Creped Tissue Formed From Stiff Cross-linked Fibers and Refined Papermaking Fibers," issued in 1969 to L. J. Bernardin. Though any blend of wet resilient pulp fibers can be used, high-yield pulp fibers are the wet resilient fiber of choice for many embodiments of the present invention for their low cost and good fluid handling performance when used according to the principles described below.

The amount of high-yield or wet resilient pulp fibers in the sheet can be at least about 10 dry weight percent or greater, more specifically about 15 dry weight percent or greater, for example from about 20 to 100 percent, more specifically about 30 dry weight percent or greater, and still more specifically about 50 dry weight percent or greater. For layered sheets, these same amounts can be applied to one or more of the individual layers. Because wet resilient pulp fibers are generally less soft than other papermaking fibers, in some applications it is advantageous to incorporate them into the middle of the final product, such as placing them in the center layer of a three-layered sheet or, in the case of a two-ply product, placing them in the inwardly-facing layers of each of the two plies.

As used herein, "noncompressive dewatering" and "noncompressive driving" refer to dewatering or drying methods, respectively, for removing water from cellulosic webs that do not involve compressive nips or other steps causing significant densification or compression of a portion of the web during the drying or dewatering process. Such methods include throughdrying; air jet impingement drying; radial jet reattachment and radial slot reattachment drying, such as described by R. H. Page and J. Seyed-Yagoobi, *Tappi J.*, 73(9): 229 (September 1990); non-contacting drying such as air flotation drying, as taught by E. V. Bowden, E. V., *Appita J.*, 44(1): 41 (1991); through-flow or impingement of superheated steam; microwave drying and other radiofrequency or dielectric drying methods; water extraction by supercritical fluids; water extraction by nonaqueous, low surface tension fluids; infrared drying; drying by contact with a film of molten metal; and other methods. It is believed that the three-dimensional sheets of the present invention could be dried or dewatered with any of the above mentioned noncompressive drying means without causing significant web densification or a significant loss of their three-dimensional structure and their wet resiliency properties. Standard dry creping technology is viewed as a compressive drying method since the web must be mechanically pressed onto part of the drying surface, causing significant densification of the regions pressed onto the heated Yankee cylinder.

DETAILED DESCRIPTION OF THE DRAWINGS

The invention will now be described in greater detail with reference to the Figures. For simplicity, the various tensioning rolls schematically used to define the several fabric runs are shown but not numbered, and similar elements in different Figures have been given the same reference numeral. A variety of conventional papermaking apparatuses and operations can be used with respect to the stock preparation, headbox, forming fabrics, web transfers, drying and creping. Nevertheless, particular conventional components are illustrated for purposes of providing the context in which the various embodiments of the invention can be used.

Several problems that occur in the production of an uncreped web using rush transfer and drum drying are overcome by the present invention. Without wishing to be bound by any particular theory, the proposed mechanism of some of the above-mentioned problems can be discussed by making reference to FIGS. 1 and 2. The transfer point or pick-up of a sheet transfer station is shown in FIG. 1. A wet paper web 1 is carried by a carrier fabric 2 traveling at a first velocity in the positive machine direction, which is the direction of arrow 60 in FIG. 1. The web 1 is transferred to a textured transfer fabric 3, which generally comprises an alternating pattern in the machine direction of knuckles 3*a* elevated toward the web 1 and depressions 3*b* recessed from the web. The carrier fabric 2 and transfer fabric 3 are adapted to come into close proximity with one another at the transfer point. The transfer fabric 3 is traveling at a second velocity substantially slower than the first velocity of the carrier fabric 2. Typically differential air pressure is applied to assist the transfer of the web 1 from the carrier fabric to the transfer fabric. For example, a vacuum box (not shown) may be positioned beneath the transfer fabric 3 to urge the web 1 toward the transfer fabric.

The rush transfer of the web 1 to the textured transfer fabric 3 generally provides the web 1 with an alternating pattern of land regions 4 and molded regions 5, as viewed in the cross-machine direction. As the knuckles 3*a* or the most elevated regions 3*a* of the transfer fabric 3 engage the web 1 that is still attached or residing on the carrier fabric 2, the slower moving knuckles scrape the surface of the web and may cause in-plane disruption of the fibrous web during the brief contact time between the carrier fabric and the transfer fabric. As the web 1 is decelerated, it may buckle and be molded into the transfer fabric 3 and/or experience microcompressions (not shown) with a length scale finer than the length scale of the transfer fabric. The scraping motion or plowing motion of the elevated knuckles 3*a* of the transfer fabric 3 may result in a more nonuniform distribution of mass and fiber-fiber bonds in the paper. The land regions 4 of the web near the elevated peaks 3*a* of the transfer fabric 3 may have been most stressed during differential rush transfer.

Figure 2:
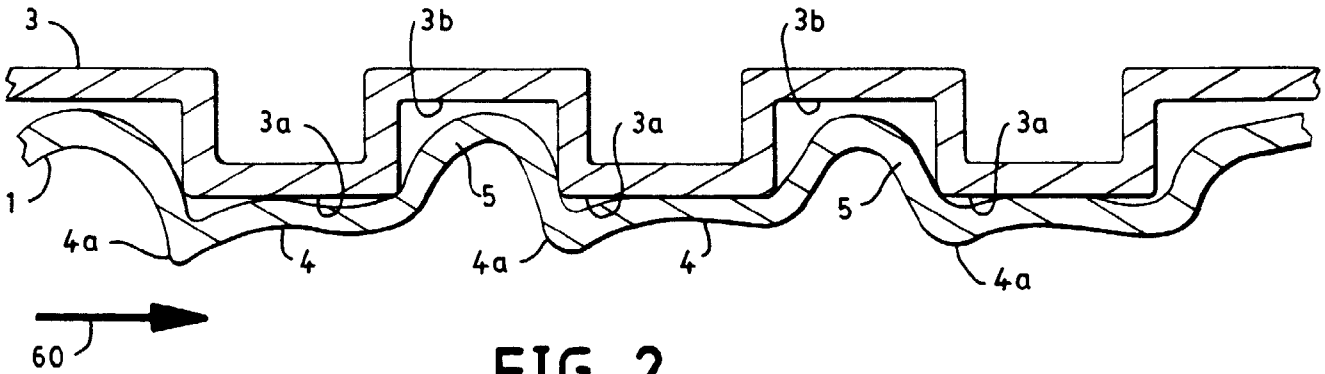
FIG. 2 representatively shows a cross section view of a web after rush transfer onto a three-dimensional transfer fabric.

A particular observation from our experimental investigations is illustrated in FIG. 2, where the web 1 is now depicted traveling with the three-dimensional transfer fabric 3 after the web has been successfully rush transferred onto the three-dimensional transfer fabric. The fabric 3 is moving from left to right as indicated by the arrow 60. Regions of the web 1 adjacent the trailing end of elevated regions 3*a* of the transfer fabric 3 may have bumps 4*a* or protrusions apparently resulting from a piling up of displaced fibrous material or from in-plane strain of the web contacted by the transfer fabric 3. Relative to the reference frame of the carrier fabric 2, which moves in the positive machine direction, the transfer fabric 3 is moving backwards in the negative machine direction. The elevated bumps 4*a* on the web 1 may be built up by a plowing action of the backward moving (relative to the web prior to transfer) structure. Adjacent regions may be highly stressed and have reduced basis weight, and the bumps 4*a* themselves may be highly stressed, especially on the surface of the web facing away from the transfer fabric.

If the web 1 in FIG. 2 were directly pressed against a Yankee dryer, the regions containing the bumps 4*a* would be most firmly pressed onto the Yankee. Upon drying, those bumps 4*a* may become firmly adhered to the Yankee through capillary tension and chemical adhesion involving organic compounds in the fibrous slurry or adhesives applied to the dryer surface or to the web. When the sheet is then pulled off the Yankee, the weak regions of attachment may fail or remain adhered on the Yankee, causing web breaks and sheet defects. Alternatively or in addition thereto, the web 1 may be excessively stressed during removal such that the sheet has reduced strength. Were the web 1 to be removed by a creping doctor, the sheet might fail. But when the sheet is pulled off the Yankee or other drum drying surface, the weakness of the highly stressed regions containing or adjoining the bumps 4*a* may compromise sheet integrity. The bumps 4*a* may remain attached to the dryer surface, with a break or defect forming in the adjacent region of the web. The problem, then, appears to be that the combination of rush transfer onto a textured web with drying on a drum dryer results in sheet picking, defects, or web failure because the regions most likely to fail are the ones that will be most stressed upon detachment of the web from the dryer surface. The problems are most severe at high speed operation when the sheet is dried to industrially valuable dryness levels.

Having discovered a possible cause of the runnability problems encountered under certain conditions in the production of high bulk, rush transferred, uncreped tissue with drum drying, several solutions have been developed. In particular, the rush transferred web is transferred at least once more in a manner that ensures that the weakest or most stressed regions 4 and 4*a* of the web 1 (and particularly the outermost portions of the web in those regions) do not become the zones of greatest attachment to the Yankee or drum dryer and possibly to assist the release of the web from the fabric once the web is placed on the cylinder dryer surface. Regardless of the causes of poor runnability in previous approaches, the methods disclosed herein have been found to result in improved sheet properties and runnability.

Figure 3:
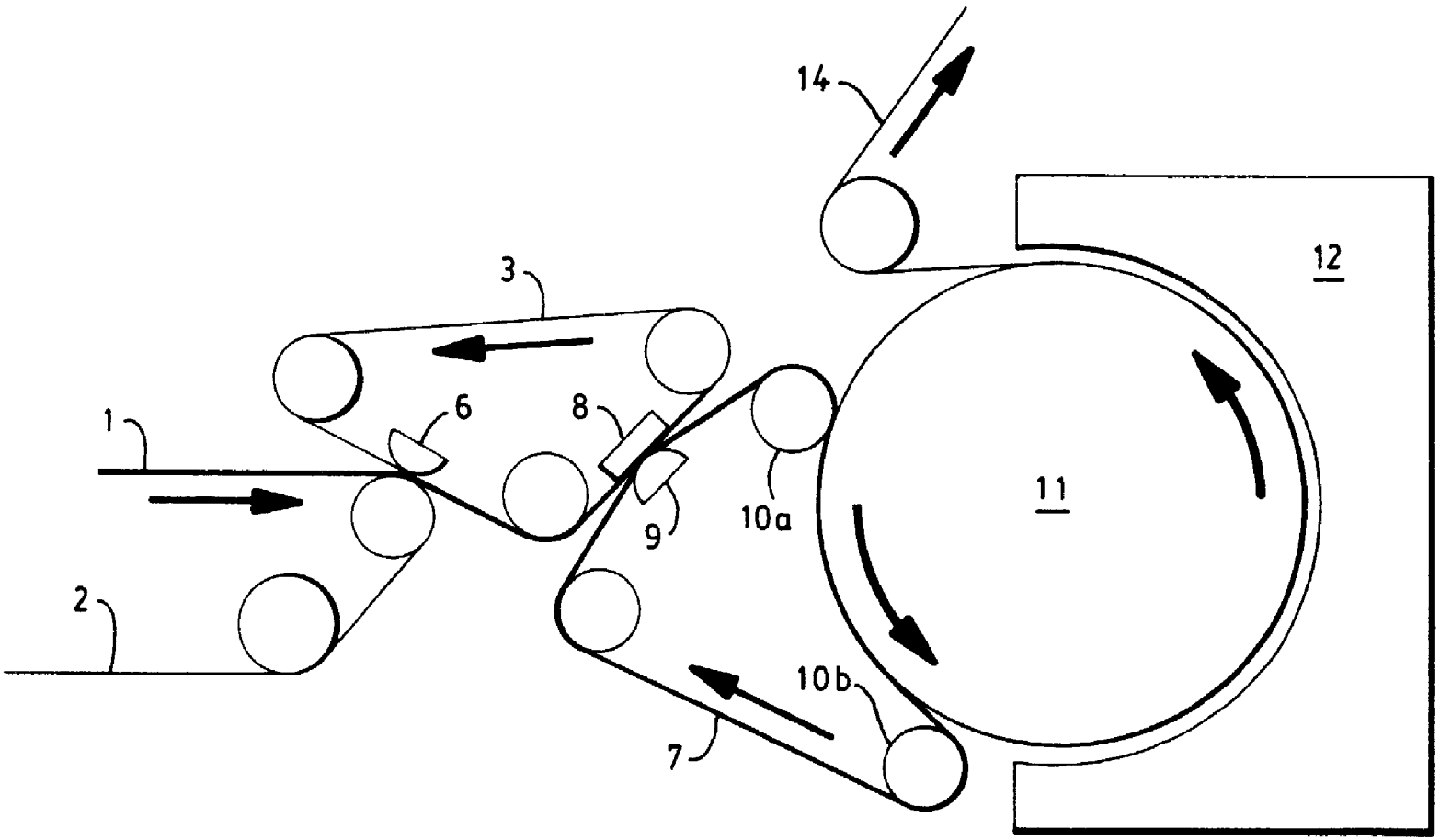
FIG. 3 representatively shows a schematic process flow diagram illustrating one embodiment of a paper machine section according to the present invention.

Ideally, the web 1 is inverted prior to attachment to the Yankee so that the surface of the web that originally contacted the transfer fabric is in contact with the Yankee when the sheet is placed thereon. One embodiment of the present invention is depicted in FIG. 3. A wet web 1 is shown riding on a carrier fabric 2 which may be a forming fabric on which an aqueous slurry is deposited from a headbox (not shown). The web is desirably dewatered while on the carrier fabric 2 to a consistency suitable for a rush transfer operation, meaning a consistency that permits the formation of a continuous web such as about 15 percent or greater, particularly about 20 percent or greater for improved performance.

The carrier fabric 2 enters a first transfer nip where a first vacuum transfer shoe 6 helps transfer the web onto a first transfer fabric 3 moving at a substantially lower velocity than the carrier fabric. The first transfer fabric 3 is a three-dimensional fabric, such as a Lindsay Wire T-116-3 design (Lindsay Wire Division, Appleton Mills, Appleton, Wis.) or another fabric based on the teachings of U.S. Pat. No. 5,429,686 issued to Kai F. Chiu et al. The web is foreshortened during rush transfer by virtue of the velocity difference between the two fabrics. For best results, the first transfer fabric 3 should be traveling more slowly than the carrier fabric 2 by about 10 percent or more, particularly by about 20 percent or more, and more particularly by about 30 percent or more. In particular embodiments, the first transfer fabric 3 travels more slowly than the carrier fabric 2 by between about 15 and about 50 percent.

The rush transferred web 1 is carried by the first transfer fabric 3 to a second transfer nip between an optional blow box 8 and a second vacuum transfer shoe 9, where the web is picked up by a second transfer fabric 7. The second transfer fabric 7 carries the web 1 into a nip between a roll 10 and a drum dryer 11, where the web is attached to the surface of the drum dryer 11. Rotation of the drum dryer 11 is depicted by arrows in the Figures. The second transfer fabric 7 desirably has a lower coarseness than the first transfer fabric 3 and is suitable for pressing enough of the sheet against the Yankee or drum dryer to promote good attachment and drying. If only a small portion of the sheet is in intimate contact with the dryer surface, heat transfer will be impeded and the machine speed must be decreased.

The transfer of the web 1 onto the second transfer fabric 7 inverts the web and ensures that the most weakened portions of the web, that is regions 4 and 4*a* as shown in FIG. 2, are not preferentially attached to the dryer surface. As a result, the web can later be removed from the dryer surface with relatively little risk of web damage.

The web then passes over roll 10*a* and is urged against the surface of the dryer cylinder 11. Roll 10*a* may be urged against the dryer cylinder 11 to provide a linear load of about 100 pli or less, preferably about 50 pli, and more preferably from about 2 to about 30 pli. Optionally, the roll 10*a* may be displaced from the dryer 11 such that there is no compressive nip at the point where the web contacts the surface of the dryer cylinder. The fabric 7 wraps the dryer cylinder along a portion of the dryer perimeter to provide sufficient residence time for the web to adhere to the cylinder rather than to the second transfer fabric 7. Thus, the web remains attached to the drying cylinder when the fabric turns away from the cylinder around roll 10*b*. The fraction of the cylinder perimeter along which the second transfer fabric is wrapped may about 5 percent or greater, more specifically about 15 percent or greater, and more specifically still from about 10 to about 30 percent. Appropriate chemistry may need to be applied to the surface of the cylinder dryer by a spray boom (not shown) or other means, and to the second transfer fabric 7 for good adhesion and release, as taught in U.S. patent application Ser. No. unknown filed on the same day as the present application by F. G. Druecke et al. titled "Method Of Producing Low Density Resilient Webs."

A degree of fabric wrap against the cylinder dryer surface is desired to assist in heat transfer and to reduce sheet handling problems. If the fabric is removed too early, the sheet may stick to the fabric and not to the cylinder dryer surface unless the web is pressed at high pressure against the dryer surface. Of course, the use of high pressure represents an undesirable solution when generally noncompressive treatment is desired for best bulk and wet resiliency. Preferably, the fabric remains in contact with the web on the dryer surface until the web has achieved a consistency of at least about 40 percent, particularly at least about 45 percent, more particularly at least about 50 percent, still more particularly at least about 55 percent, and even more particularly at least about 60 percent, for improved performance. The pressure applied to the web is desirably although not necessarily in the range of 0.1 to 5 psi, more particularly in the range of 0.5 to 4 psi, and more particularly still in the range of about 0.5 to 3 psi.

After the web is attached to the dryer surface, it may be further dried with a high-temperature air impingement hood 12 or other drying means. The partially dried web is then removed from the surface of the dryer 11 and the detached web 14 is then subjected to further drying (not shown), if needed, or other treatments before being reeled.

Figure 4:
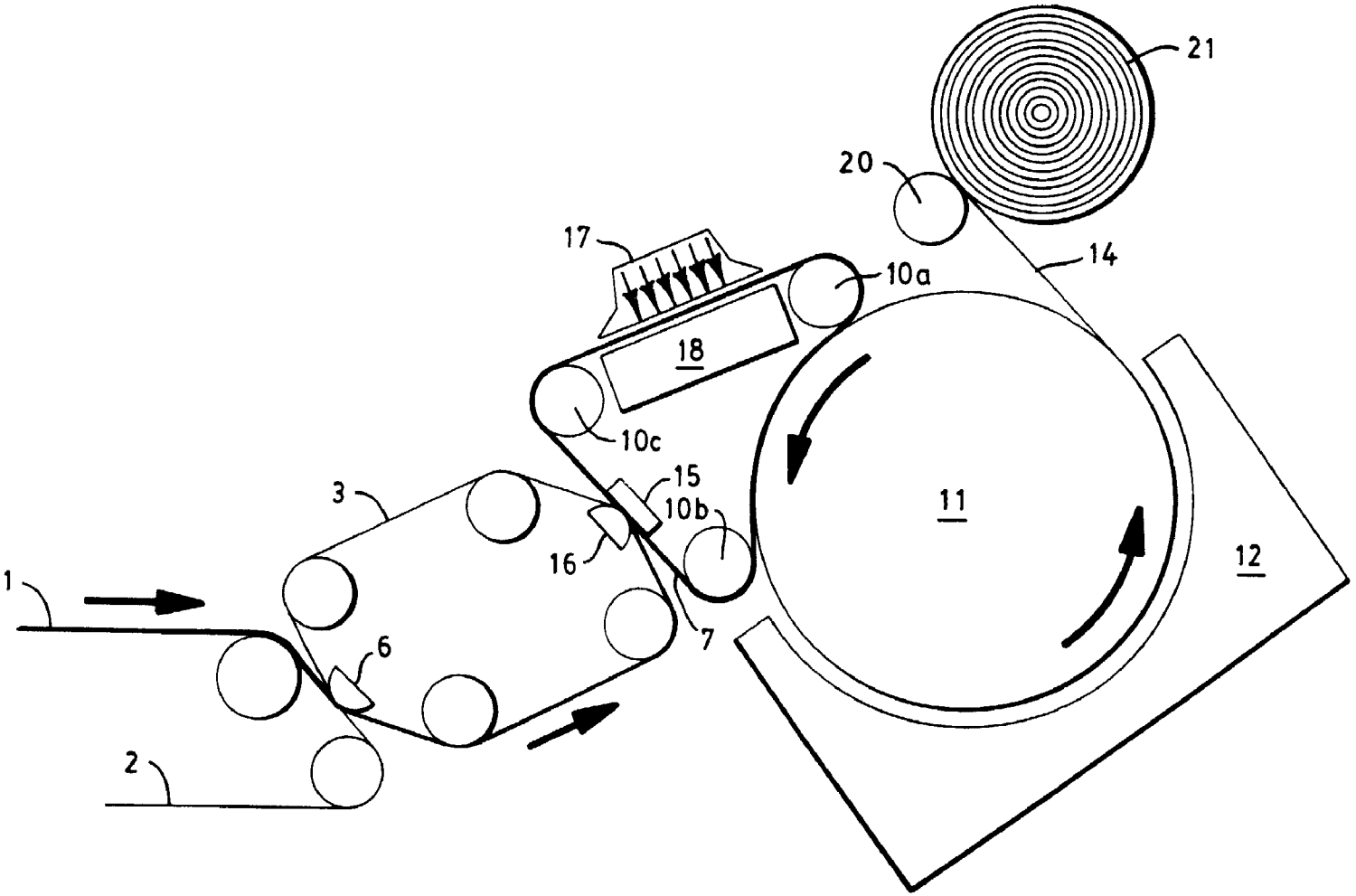
FIG. 4 representatively shows a schematic process flow diagram illustrating a second embodiment of a paper machine section according to the present invention.

An alternative embodiment of the present invention is illustrated in FIG. 4, where a web 1 rides on a carrier fabric 2 until reaching a consistency of desirably about 10 to about 30 percent, at which time the web is transferred at a first transfer point to a first transfer fabric 3 with the assistance of a vacuum transfer shoe 6. The first transfer fabric 3 has substantially more void volume than the carrier fabric and desirably has a three-dimensional topography characterized by elevated machine-direction knuckles which rise above the highest cross-direction knuckles by at least 0.2 mm, particularly at least 0.5 mm, and more particularly at least about 1 mm. In particular embodiments, the machine direction knuckles rise above the highest cross-direction knuckles by between about 0.8 and about 3 mm.

The wet web travels to a second transfer point where a blow box 16 and a vacuum box 15 cooperate to transfer the web to a second transfer fabric 7 which may be moving less rapidly than the first transfer fabric 3. The second transfer fabric 7 desirably has a fabric coarseness about half that of the first transfer fabric or less, provided that the majority of any applied rush transfer imparted to the web occurs during the first transfer. If the majority of any rush transfer applied to the web occurs during the transfer to the second transfer fabric, then it may be desirable for the second transfer fabric to be more coarse than the first transfer fabric, preferably having a fabric coarseness at least 30 percent greater than that of the first transfer fabric. Rush transfer can occur at either transfer point or at both points. The amount of rush transfer is proportional to the absolute speed difference in feet per minute that the web experiences in a transfer.

After being transferred onto the second transfer fabric 7, the web passes through an optional noncompressive dewatering operation such as the air press shown in FIG. 4. The air press comprises a pressurized upper plenum 17 and a lower vacuum box 18 in cooperative relationship such that pressurized air from the plenum 17 passes through the web and into the vacuum box 18, thus dewatering the web to a consistency of preferably about 30 percent or greater, more preferably about 32 percent or greater, and more preferably still about 33 percent or greater. An additional support fabric (not shown) may be placed in contact with the web 1 to sandwich the web between the second transfer fabric 7 and the support fabric as the web travels through the air press. Suitable air presses are disclosed in U.S. patent application Ser. No. 08/647,508 filed May 14, 1996, by M. A. Hermans et at. titled "Method and Apparatus for Making Soft Tissue" and U.S. patent application Ser. No. unknown filed on the same day as the present application by F. Hada et al. titled "Air Press For Dewatering A Wet Web"; which are incorporated herein by reference.

The web then passes over roll 10*a* and is urged against the surface of the dryer cylinder 11. The fabric 7 may wrap the dryer cylinder until it turns away from the cylinder around roll 10*b*. After being removed from the second transfer fabric 7, the web resides on the surface of the cylinder dryer 11 and passes through an optional dryer hood 12 featuring high velocity impingement of heated air. The dried web 14 can then be wound into a reel 21 with the assistance of another roll 20 or additional rolls or a belt drive system, which is generally preferable for high bulk tissue materials.

Figure 5:
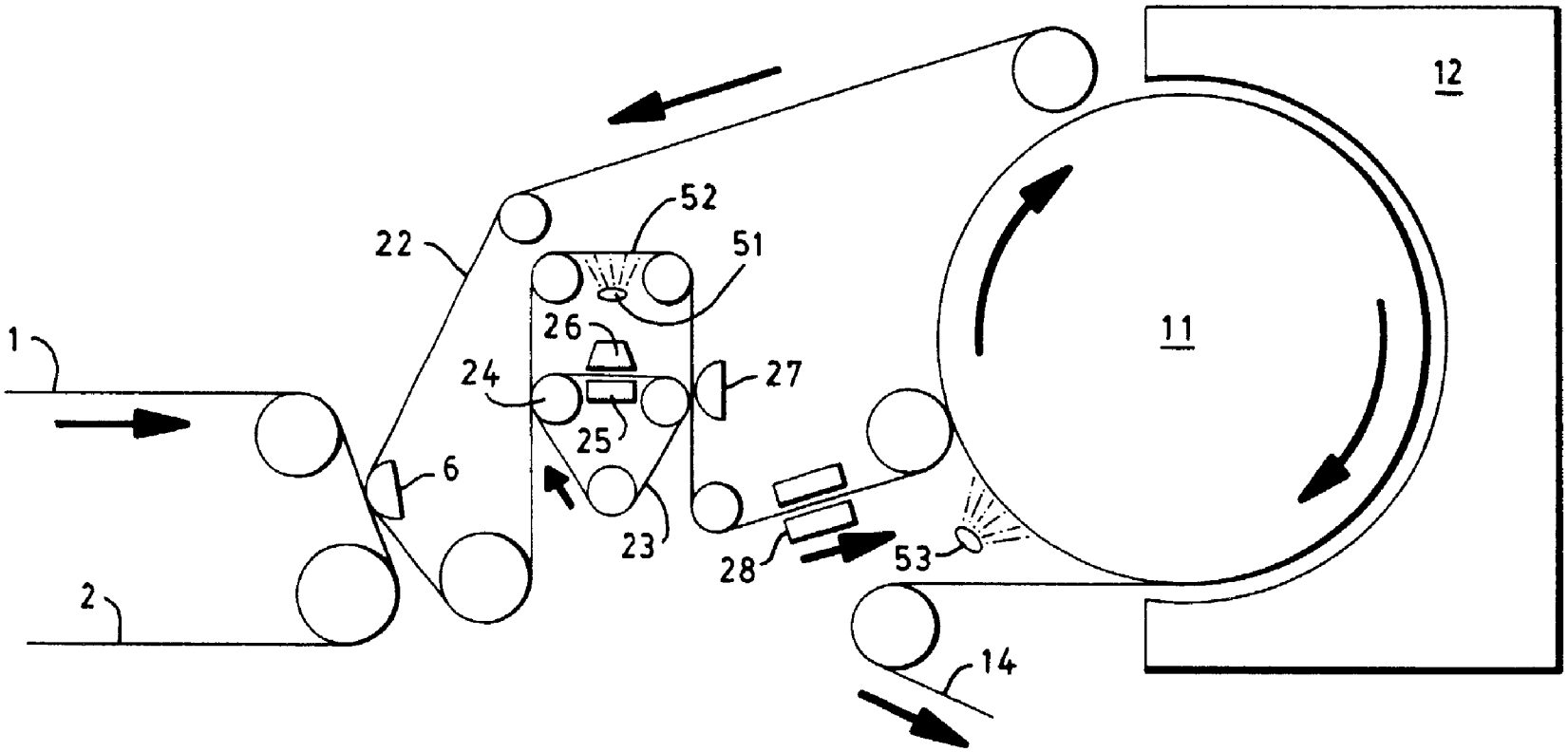
FIG. 5 representatively shows a schematic process flow diagram illustrating a third embodiment of a paper machine section according to the present invention.

One alternative to the web inversion method disclosed in relation to FIGS. 3 and 4 is to shift the registration of the web on the first transfer fabric such that the previously raised portions of the web no longer reside over the raised portions of the first transfer fabric. The result of this registration shifting method is that the raised regions of the web on the first transfer fabric do not become the primary contact points against the cylinder dryer. With reference to FIG. 5, a web 1 is transferred from a forming fabric 2 to a slower-moving first transfer fabric 22 by means of a pick-up shoe 6 at the location of the first transfer point. A shift in the registration of the rush-transferred, molded web with respect to the structure of the first transfer fabric is achieved by transferring the web off the first transfer fabric 22 onto a second transfer fabric 23 at a second transfer point where the second transfer fabric is backed by roll 24 (or a vacuum shoe may be used), and then back onto the first transfer fabric at a third transfer point corresponding approximately to the location of a vacuum slot in vacuum shoe 27. This repositioning of the web 1 is intended to ensure that those portions of the web once in contact with the highest portions of the first transfer fabric surface are now in contact with less elevated portions of the first transfer fabric surface, or at a minimum, to effect a preliminary release of the web from the fabric to facilitate the subsequent release that will occur as the fabric is urged onto the surface of the dryer 11, and to cause macroscopic rearrangement of the web relative to the first transfer fabric to decrease the chances of having the weakest portions most tightly attached to the cylinder dryer.

To achieve the most effective reregistration, attention should be paid to path lengths between the second and third transfer points. As shown in FIG. 5, the first transfer fabric traverses a greater path length between the second and third transfer points than does the second transfer fabric and the web itself. The difference in the path lengths for the first transfer fabric and the web must not be an integral multiple of the characteristic MD unit cell length of the first transfer fabric. Rather, there must be a fractional offset such that the portions of the web once in contact with the most elevated parts of the first transfer fabric before the second transfer point are now displaced from those most elevated parts of the first transfer fabric by an offset distance. Ideally, the offset distance is one half of the MD unit cell length, but in practice the offset, in units of the characteristic MD unit cell length, may take any form from about 0.2 to about 0.8, particularly from about 0.3 to about 0.7, and more particularly from about 0.4 to about 0.6.

Additional treatment of the web with differential air pressure may be achieved while the web is on the second transfer fabric. As shown in FIG. 5, the web is further molded into the second transfer fabric or further dewatered by the combination of a pressurized air or steam box, 26, and a vacuum box, 25. In this case, it is possible for the second transfer fabric to have any arbitrary texture since it will not contact the cylinder dryer. Indeed, in the embodiment of FIG. 5, the first transfer fabric may have an intermediate coarseness greater than that of the forming fabric 1 but less than that of the second transfer fabric, wherein the second transfer fabric may become the primary means of large scale texture. Thus, rush transfer may be primarily executed at the first transfer point near the first vacuum transfer shoe 6, and instead of inverting the sheet, improved runnability may be achieved by reregistration of the web on the first transfer fabric by using two additional transfers onto and off a second transfer fabric, with proper position of the second transfer fabric loop to ensure that reregistration occurs properly. A degree of fabric wrap provided by the first transfer fabric under adequate tension in contact with the cylinder dryer 11 is desirable to improve heat transfer and prevent sheet release problems. During the interval when the web has been temporarily removed from the first transfer fabric, that fabric may be treated with a release agent such as a silicone oil solution or emulsion on the web contacting side of the fabric to facilitate its subsequent release from the web after the web is placed on the dryer surface. The spray 52 is desirably applied by a spray boom or spray shower 51. Also shown is a separate spray boom 53 which applies a spray 54 to the dryer drum 11, to provide an adequate balance of adhesion and release for the web on the dryer surface.

After being transferred back to the first transfer fabric 22, the web may be further molded into the first transfer fabric or further dewatered by molding or dewatering operation 28 which can include a steam box with a vacuum box beneath the web, an air press, displacement dewatering, or other noncompressive dewatering means or texturing means. The web is then contacted against the dryer cylinder, preferably with some degree of wrap, whereupon the first transfer fabric detaches from the cylinder dryer while the web 1 remains attached and is further dried by a heated air hood or other means prior to detachment of the web from the cylinder dryer, which preferably is done without creping.

In the above embodiments, the wet web 1 is desirably applied to the Yankee without significant densification of the web. The combination of noncompressive dewatering, low pressure application of the web on the cylinder dryer surface, and the use of a properly selected fabric or felt for applying the web onto the cylinder dryer such that the web is not highly densified by protrusions on the fabric or felt can result in a dried web of substantially uniform density. Whether the web has substantially uniform density or regions of high and low density, the average bulk (inverse of density) of the web based on measurement of web thickness between flat platens can be about 3 cc/g (cubic centimeters per gram) or greater, particularly about 6 cc/g or greater, more particularly about 10 cc/g or greater, more particularly about 12 cc/g or greater, and more particularly still about 15 cc/g or greater. High-bulk webs are often calendered to form a final product. After optional calendering of the web, the bulk of the finished product can be about 4 cc/g or greater, particularly about 6 cc/g or greater, more particularly still about 7.5 cc/g or greater, and still more particularly about 9 cc/g or greater.

Since the fabric that presses the sheet against the dryer may have a three-dimensional surface, there may be knuckles which preferentially hold portions of the sheet against the dryer surface, though desirably the sheet would not be substantially densified in those knuckle regions because of adequate noncompressive drying prior to drying and by virtue of relatively low pressure applied by the fabric. Thus, it is possible to create a web having substantially uniform density, and having either a uniform or nonuniform distribution of wet strength agents, dry strength compounds, salts, dyes, or other additives and compounds.

Figure 6:
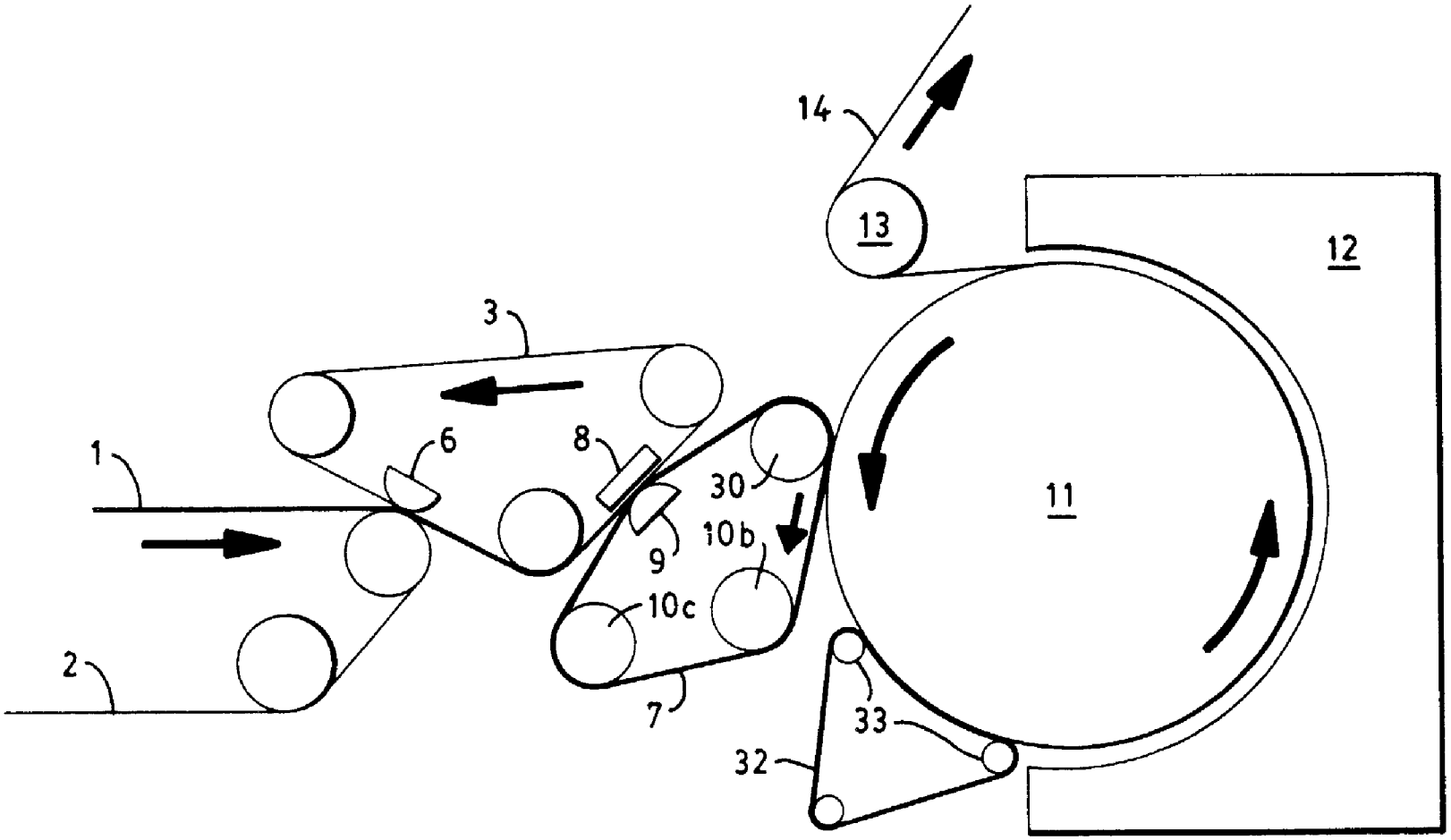
FIG. 6 representatively shows a schematic process flow diagram illustrating a fourth embodiment of a paper machine section according to the present invention.

Another embodiment of the invention is illustrated in FIG. 6, which is similar to the embodiment of FIG. 3 before the second transfer. At the second transfer, the web 1 is placed on the second transfer fabric 7, from which the web 1 is attached to the cylinder dryer 11 with a loaded pressure roll 30 at conventional roll loadings or nip pressures. This results in patterned densification of the web 1 by the foraminous fabric 7 which is pressed into the web. The fabric 7 may wrap the dryer 11, but relatively little wrap, that is less than 5 percent of the dryer perimeter, is shown. The web 1, once attached to the cylinder dryer 11, may be further restrained or held in contact with the heated surface by an optional additional loop of dryer fabric 32 held in contact with a portion of the cylinder dryer surface by rolls 33 which may be exert pressure on the dryer cylinder or which may be separated from the dryer surface by a gap such that the rolls exert no direct force on the dryer other than the force of the tension in the fabric 32. The fabric 32 should travel at the same speed as the web 1 on the surface of the cylinder dryer, but some velocity difference may be desired in some embodiments to soften or otherwise modify the airside surface of the web. The fabric 32 may be flat or patterned and may have a three-dimensional topography.

As in FIG. 3, the web on the dryer 11 is dried by heat transfer from heated air in the hood 12 and by conduction from the dryer itself prior to detachment from the dryer surface. Detachment is preferably done without creping, but a crepe blade may be present to assist in removal of the web.

EXAMPLES

The following EXAMPLES serve to illustrate possible approaches pertaining to the present invention in which improved fluid handling, void volume, and surface texture are achieved through the novel constructions herein disclosed. The particular amounts, proportions, compositions and parameters are meant to be exemplary, and are not intended to specifically limit the scope of the invention.

Example 1

To illustrate the effectiveness of a second fabric-to-fabric transfer following a rush transfer stage in enhancing certain web properties, trials were conducted on a model papermaking machine operating as a throughdryer, without a dryer drum. The purpose of the trial was to examine the effect of rush transfer strategy relative to having a second transfer operation after a first rush transfer stage. A papermaking furnish was prepared from 40 percent spruce BCTMP fibers and 60 percent by weight of Coosa Pines LL19 bleached kraft softwood fibers. The fibers were diluted to 1 percent consistency. KYMENE 557LX wet strength additive (Hercules, Inc., Wilmington, Del.) was added at a dose of 0.4 percent on a dry fiber weight basis. In a first subset of this example, representing a preferred transfer method, the slurry was delivered by a flow spreader onto a smooth forming fabric at 40 feet per minute. The embryonic web was dewatered with vacuum boxes and then rush transferred onto a coarse, three-dimensional fabric, a Lindsay Wire (a subsidiary of Appleton Mills, Appleton, Wis.) T-116-3 fabric. The degree of rush transfer varied, as shown in Table 1. The rush transferred web was then transferred to a less textured fabric, a Lindsay Wire L-452 throughdrying fabric. The web was then dried on a throughdryer and reeled.

In a second variation, representing a less preferred method, the embryonic web was first transferred without rush to an Albany Felt fabric, Velostar 800, from which the web was then rush transferred to the coarser Lindsay Wire T-116-3 fabric. The T-116-3 fabric had a mesh count of 71×64 and a coarseness of 0.6 mm; the Velostar 800 had a mesh count of 48×32.

Results for the preferred method are shown in Table 1, while Table 2 gives results for the less preferred method. In the tables, "BW" refers to the basis weight of the web reported in grams per square meter and "Caliper" refers to the thickness of a single sheet reported in thousandths of an inch. In both cases, rush transfer was applied as the web went onto the coarser fabric but not when the transfer to the less coarse fabric was made. Thus the reported values refer to a process in which the web was rush transferred onto a coarse fabric, and in the preferred method, was subsequently transferred again onto a less coarse fabric. After the two transfer stages, both webs were throughdried to completion and reeled without calendering.

Figure 7:
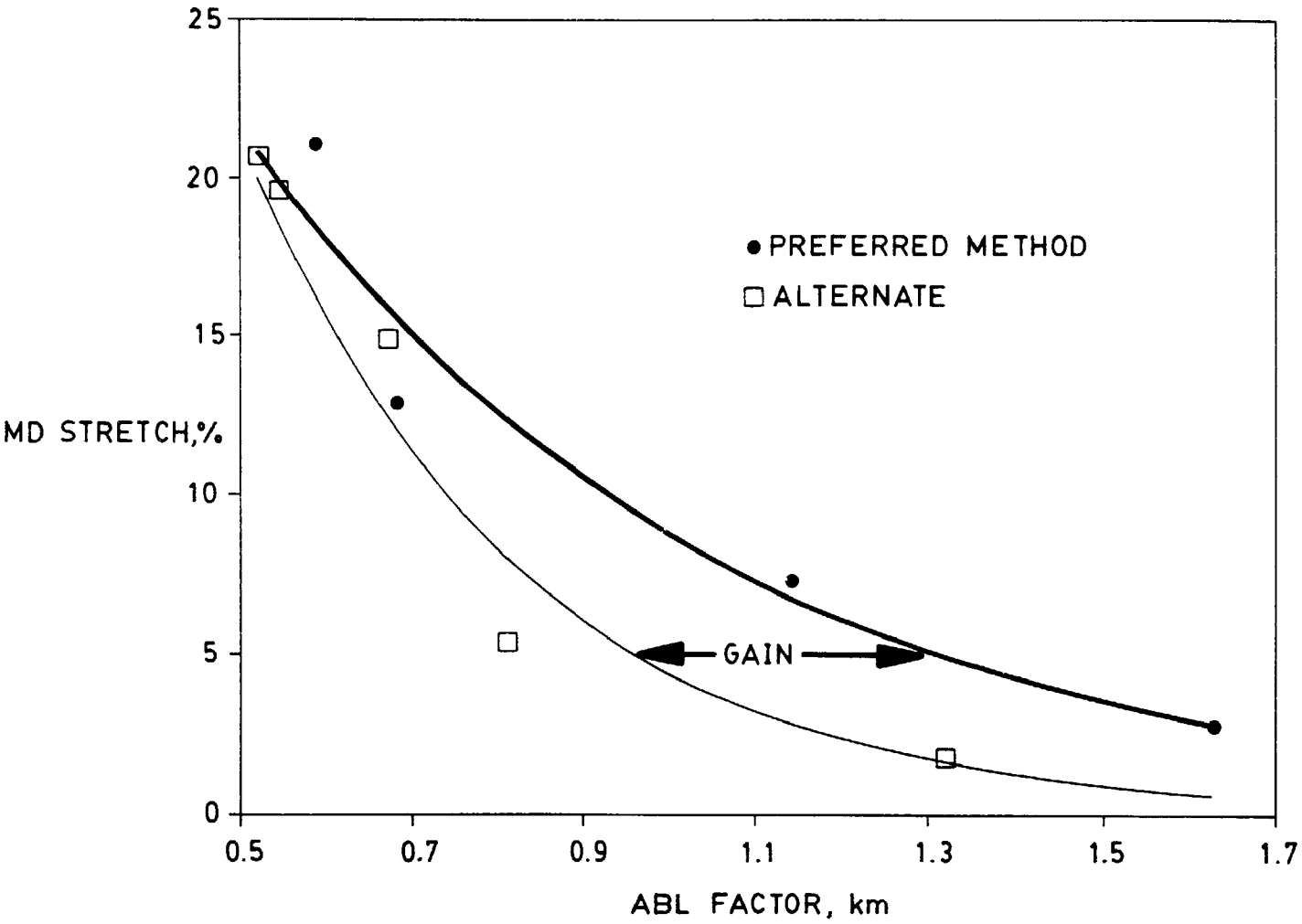
FIG. 7 representatively shows a schematic process flow diagram illustrating a graph of data showing physical properties of some webs.

The MD stretch and ABL factor data are depicted in FIG. 7, which shows that the second transfer stage after an initial rush transfer stage allow webs to achieve higher strength at a given degree of CD stretch, and visa versa. For example, at a MD stretch of 5 percent, the preferred rush transfer method gives over a 30 percent increase in strength. A web with adequate MD stretch and high strength is a good candidate for drum drying, for the sheet could be pulled off the drum without creping or less desirably with light creping of the web. The improved strength or stretch translates into improved runnability of a machine and improved physical properties of the finished product.

TABLE 1

| % Rush Transfer | BW (gsm) | Caliper, mils | MD Tensile, g/3 in. | % MD Stretch | CD Tensile, g/3 in. | % CD Stretch | ABL, km |
|---|---|---|---|---|---|---|---|
| 0 | 21.9 | 11.7 | 4010 | 2.8 | 1837 | 1.8 | 1.63 |
| 10 | 21.3 | 15.4 | 2473 | 7.3 | 1398 | 2.4 | 1.14 |
| 20 | 23.9 | 17.5 | 1345 | 12.9 | 1144 | 3.1 | 0.68 |
| 30 | 23.7 | 19.9 | 1052 | 21.1 | 1060 | 3.9 | 0.58 |

TABLE 2

| % Rush Transfer | BW (gsm) | Caliper, mils | MD Tensile, g/3 in. | % MD Stretch | CD Tensile, g/3 in. | % CD Stretch | ABL, km |
|---|---|---|---|---|---|---|---|
| 30 | 21.2 | 32.8 | 763 | 20.7 | 918 | 8.9 | 0.52 |
| 0 | 23.0 | 25.6 | 3716 | 1.8 | 1473 | 5.1 | 1.32 |
| 10 | 23.8 | 29.8 | 1790 | 5.4 | 1214 | 7.1 | 0.81 |
| 20 | 22.8 | 30.5 | 1140 | 14.9 | 1197 | 8.3 | 0.67 |
| 30 | 22.7 | 31.4 | 815 | 19.6 | 1076 | 8.1 | 0.54 |

Example 2

A layered web with long fibers in a first layer and shorter, curled fibers in a second layer is made with a stratified headbox which deposits a low consistency slurry (less than 0.6%) onto a textured forming fabric capable of imparting variable mass distribution in a web during the formation stage. The second layer contains 0.1 percent or greater debonding agents, while the first layer contains 0.1 percent or greater wet strength resins. The web is dewatered by vacuum boxes and foils to a consistency of 18 percent to 20 percent or above, and then rush transferred at a level of at least 10 percent rush and particularly at least 25 percent rush onto an endless loop of a textured throughdrying fabric (the first transfer fabric or a fabric with a fabric coarseness of about 1 mm) such as a Lindsay Wire T-216-3 fabric. Following rush transfer, the sheet is dewatered to a consistency of about 30 percent or greater, particularly about 36 percent or greater, by means of an air press in which substantially all of the applied air passes through the web, with air pressures over 30 psi and desirably over 60 psi, with a vacuum box beneath the contact region of the air press to further pull gas through the sheet. The sheet is preheated by a steam box before the air press. The textured, rush transferred web is then transferred to a relatively smooth fabric or felt, the latter being textured or conventional, having a Fabric Coarseness at least 20 percent less that that of the first transfer fabric and desirably at least 50 percent less. The fabric or felt then lightly wraps the Yankee surface for at least 2 feet, particularly at least 7 feet, and applies sufficient pressure through fabric tension to hold the sheet in place on the Yankee, while the pressure roll which attaches the web to the Yankee is loaded to less than 30 percent of its conventional load to reduce sheet compaction. The sheet is dried to a consistency of at least 70 percent on the Yankee, after which it is further dried by additional drum dryers. The sheet may be embossed and otherwise converted for commercial use. The web may be molded by air pressure differentials to conform with either or both of the first and second transfer fabrics. Further, a textured pressure roll such as a grooved roll may be used to impart additional texture to the web or to maintain fabric texture. The web may be used as bath tissue, facial tissue, absorbent paper towel, an absorbent layer in an absorbent article, a portion of a disposable garment, and the like.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Further, various alternative process and equipment arrangements may be employed, particularly with respect to the stock preparation, headbox, forming fabrics, web transfers, drying and creping, or as disclosed in U.S. patent application Ser. No. unknown filed on the same day as the present application by M. Hermans et al. and titled "Method For Making Tissue Sheets On A Modified Conventional Wet-Pressed Machine"; U.S. patent application Ser. No. unknown filed on the same day as the present application by M. Hermans et al. and titled "Method For Making Low-Density Tissue With Reduced Energy Input"; and U.S. patent application Ser. No. 08/912906 filed on Aug. 15, 1997 by F. Chen et al. and titled "Wet-Resilient Webs And Disposable Articles Made Therewith"; which are incorporated herein by reference. Therefore, the invention should not be limited by the specific embodiments described, but only by the claims and all equivalents thereto.

We claim:

1. A method for producing a tissue web, comprising:

a) depositing an aqueous suspension of papermaking fibers onto a forming fabric to form a wet web;

b) dewatering the wet web to a consistency suitable for a rush transfer operation;

c) rush transferring the dewatered web to a first transfer fabric having a three-dimensional topography;

d) transferring the web to a second transfer fabric;

e) transferring the web to the surface of a drum dryer; and f) removing the web from the surface of the drum dryer, wherein no rotary throughdryer has been used to dry the web.

2. The method of claim 1, wherein the second transfer fabric has a lower Fabric Coarseness than the first transfer fabric.

3. The method of claim 1, further comprising transferring the web from the second transfer fabric back to the first transfer fabric such that the web is repositioned on the first transfer fabric.

4. The method of claim 3, wherein the web has a first surface which contacts the first transfer fabric during rush transfer and an opposite second surface which later contacts the drum dryer.

5. The method of claim 3, further comprising applying a release agent to the first transfer fabric after the first transfer and before the web is transferred back to the first transfer fabric.

6. A method for producing a tissue web, comprising:

a) depositing an aqueous suspension of papermaking fibers onto a forming fabric to form a wet web;

b) dewatering the wet web to a consistency of about 20 percent or greater;

c) rush transferring the dewatered web to a first transfer fabric having a three-dimensional topography with a greater Fabric Coarseness than the forming fabric;

d) transferring the web to a second transfer fabric having a lower Fabric Coarseness than the first transfer fabric;

e) transferring the web from the second transfer fabric to the surface of a drum dryer with a pressure adapted to maintain a substantially three-dimensional topography in the web;

f) drying the web; and g) removing the web from the surface of the drum dryer, wherein no rotary throughdryer has been used to dry the web.

7. The method of claim 1 or 6, wherein the web has a first surface which contacts the first transfer fabric during rush transfer and which later contacts the surface of the drum dryer.

8. The method of claim 7, wherein the degree of rush transfer is about 10 percent or greater.

9. The method of claims 1 or 6, wherein the web has a first surface that contacts the first transfer fabric, and wherein transferring the web to the surface of the drum dryer comprises transferring the web from the second transfer fabric in sequence to an even number of additional fabrics prior to transferring the web to the surface of the drum dryer, whereby the first surface of the web contacts the drum dryer.

10. The method of claim 1 or 6, wherein the first transfer fabric has a Fabric Coarseness of 0.2 mm to 1.5 mm.

11. The method of claim 1 or 6 wherein the first transfer fabric has a Fabric Coarseness of 0.5 mm or greater.

12. The method of claim 11, wherein the first transfer fabric has a Fabric Coarseness of 0.5 mm to 1.2 mm.

13. The method of claim 1 or 6, wherein the first transfer fabric has a Fabric Coarseness at least three times as great as the Fabric Coarseness of the forming fabric and at least 10 percent more than the than Fabric Coarseness of the second transfer fabric.

14. The method of claim 1 or 6, wherein the web is removed from the surface of the drum dryer without creping.

15. The method of claim 1 or 6, wherein the web is removed from the surface of the drum dryer by creping.

16. The method of claim 15, wherein the creping does not substantially alter the topography of the web.

17. The method of claim 1 or 6, wherein the web is dewatered to a consistency of about 25 percent or greater prior to being transferred to the surface of the drum dryer.

18. The method of claim 17, wherein the web is dewatered to a consistency of about 30 percent or greater prior to being transferred to the surface of the drum dryer.

19. The method of claim 1 or 6, wherein the web is noncompressively dewatered to a consistency of about 30 percent or greater prior to being transferred to the surface of the drum dryer.

20. The method of claim 19, wherein an air press is used to dewater the web.

21. The method of claim 19, wherein a gas is passed through the web to dewater the web prior to contact with the drum dryer.

22. The method of claim 1 or 6, further comprising wrapping a portion of the drum dryer with a fabric to maintain good thermal contact between the surface of the drum dryer and the web.

23. The method of claim 22, wherein the wrapped fabric is a resilient papermaking felt having a three-dimensional surface structure which differentially compresses the web on the surface of the drum dryer.

24. The method of claim 1 or 6, wherein the maximum pressure exerted against the web while the web is in contact with the second transfer fabric and in contact with the surface of the drum dryer is about 100 pounds per lineal inch or less at the point of maximum pressure.

25. The method of claim 1 or 6, wherein the web has a substantially uniform density and a three-dimensional topography prior to deposition on the drum dryer.

26. The method of claim 25, wherein the dried web has a substantially uniform density.

27. The method of claim 1 or 6, wherein the dried web has a bulk of about 6 cc/g or greater.

28. The method of claim 27, wherein the dried web has a bulk of about 9 cc/g or greater.

29. The method of claim 1 or 6, wherein the papermaking fibers comprise at least about 10 percent chemically stiffened cellulosic fibers.

30. The method of claim 1 or 6, wherein the papermaking fibers comprise at least about 10 percent high yield fibers.

31. The method of claim 1 or 6, wherein the papermaking fibers comprise at least about 20 percent recycled fibers.

32. The method of claim 1 or 6, wherein the aqueous suspension contains an effective amount of a wet strength additive, such that the wet:dry tensile strength ratio of the dried web is at least 0.10.

33. The method of claim 1 or 6, wherein the aqueous suspension contains fiber debonding agents.

34. The method of claim 1 or 6, wherein the machine speed at the drum dryer is at least 1500 feet per minute.

35. The method of claim 34, wherein the machine speed at the drum dryer is at least 2000 feet per minute.

36. The method of claim 6, wherein no rotary through-dryer is used to dry the web.

* * * * *